US008708473B2

(12) United States Patent
Namba et al.

(10) Patent No.: US 8,708,473 B2
(45) Date of Patent: Apr. 29, 2014

(54) INKJET RECORDING TREATMENT LIQUID, INKJET CARTRIDGE, INKJET RECORDING INK SET, AND INKJET RECORDING METHOD

(75) Inventors: Michihiko Namba, Yokohama (JP); Hidetoshi Fujii, Ebina (JP); Takashi Tamai, Ebina (JP); Akihiko Gotoh, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 193 days.

(21) Appl. No.: 13/162,949

(22) Filed: Jun. 17, 2011

(65) Prior Publication Data

US 2011/0310166 A1 Dec. 22, 2011

(30) Foreign Application Priority Data

Jun. 17, 2010 (JP) ..... 2010-138592

(51) Int. Cl.
*B41J 2/01* (2006.01)
*B41J 2/21* (2006.01)

(52) U.S. Cl.
CPC . *B41J 2/01* (2013.01); *B41J 2/2107* (2013.01)
USPC ..... 347/100; 347/95

(58) Field of Classification Search
CPC ..... B41J 2/01; B41J 2/2107
USPC ..... 347/100, 95, 96, 101, 102, 103, 105, 347/88, 99, 20, 21, 9; 106/31.6, 31.13, 106/31.27; 523/160, 161
See application file for complete search history.

(56) References Cited

U.S. PATENT DOCUMENTS

| | | | |
|---|---|---|---|
| 5,952,048 | A | 9/1999 | Tsubuko et al. |
| 6,578,958 | B2 | 6/2003 | Gotoh et al. |
| 6,695,443 | B2 | 2/2004 | Arita et al. |
| 6,730,149 | B2 | 5/2004 | Arita et al. |
| 6,730,155 | B2 | 5/2004 | Gotoh et al. |
| 6,786,588 | B2 | 9/2004 | Koyano et al. |
| 6,899,751 | B2 | 5/2005 | Arita et al. |
| 6,918,662 | B2 | 7/2005 | Arita et al. |
| 7,033,013 | B2 | 4/2006 | Koyano et al. |
| 7,094,813 | B2 | 8/2006 | Namba et al. |
| 7,284,851 | B2 | 10/2007 | Bannai et al. |
| 7,374,608 | B2 | 5/2008 | Arita et al. |
| 7,490,930 | B2 | 2/2009 | Morohoshi et al. |
| 7,682,011 | B2 | 3/2010 | Namba et al. |
| 7,699,457 | B2 | 4/2010 | Namba et al. |
| 7,810,919 | B2 | 10/2010 | Kojima et al. |
| 7,892,340 | B2 | 2/2011 | Namba et al. |
| 8,029,122 | B2 | 10/2011 | Kojima et al. |
| 2005/0007431 | A1* | 1/2005 | Koyano et al. ..... 347/95 |
| 2006/0176349 | A1 | 8/2006 | Nagai et al. |
| 2007/0197685 | A1* | 8/2007 | Aruga et al. ..... 523/160 |
| 2008/0248260 | A1* | 10/2008 | Kojima et al. ..... 347/100 |
| 2008/0273045 | A1 | 11/2008 | Morohoshi et al. |
| 2008/0302268 | A1 | 12/2008 | Arita et al. |
| 2009/0135218 | A1 | 5/2009 | Morohoshi et al. |
| 2009/0162569 | A1 | 6/2009 | Morohoshi et al. |
| 2009/0186162 | A1 | 7/2009 | Namba et al. |
| 2009/0239044 | A1 | 9/2009 | Habashi et al. |
| 2009/0258196 | A1 | 10/2009 | Nagashima et al. |
| 2009/0263632 | A1 | 10/2009 | Kojima et al. |
| 2010/0020142 | A1 | 1/2010 | Bannai et al. |
| 2010/0112219 | A1 | 5/2010 | Yokohama et al. |
| 2010/0245416 | A1 | 9/2010 | Ohshima et al. |
| 2010/0271435 | A1 | 10/2010 | Kojima et al. |
| 2010/0279035 | A1 | 11/2010 | Namba et al. |
| 2010/0302326 | A1 | 12/2010 | Morohoshi et al. |
| 2011/0205288 | A1 | 8/2011 | Matsuyama et al. |
| 2011/0216123 | A1 | 9/2011 | Tamai et al. |
| 2012/0236066 | A1 | 9/2012 | Tamai et al. |

FOREIGN PATENT DOCUMENTS

| | | |
|---|---|---|
| JP | 2004-142291 | 5/2004 |
| JP | 2004-330569 | 11/2004 |
| JP | 2008-260307 | 10/2008 |
| JP | 2009-166387 | 7/2009 |
| JP | 2011-190406 | 9/2011 |

OTHER PUBLICATIONS

Office Action issued Jan. 28, 2014, in Japanese Patent Application No. 2010-138592.

* cited by examiner

*Primary Examiner* — Manish S Shah
(74) *Attorney, Agent, or Firm* — Oblon, Spivak, McClelland, Maier & Neustadt, L.L.P.

(57) ABSTRACT

Inkjet recording treatment liquids include: at least one water-soluble organic solvent; water; at least one compound according to formula (I)

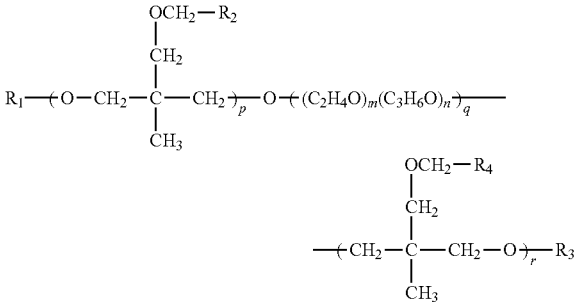

wherein: each of $R_1$ and $R_3$ independently represents H, a lower alkoxy group, or a lower perfluoroalkoxy group; each of $R_2$ and $R_4$ independently represents a lower perfluoroalkyl group; each of p, q, and r is independently an integer of 1 to 24; m is an integer of 1 to 28; and n is an integer of 0 to 10; and at least one compound according to formula (II)

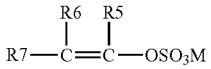

wherein: each of R5, R6, and R7 independently represents a lower alkyl group, a lower perfluoroalkoxy group, or F; and M is Li, Na, or K. Methods of inkjet recording, inkjet recording apparatus, storage bags, and cartridges employing the inkjet recording treatment liquids are also provided.

20 Claims, 2 Drawing Sheets

INKJET RECORDING TREATMENT LIQUID, INKJET CARTRIDGE, INKJET RECORDING INK SET, AND INKJET RECORDING METHOD

CROSS REFERENCES TO RELATED APPLICATIONS

This application claims priority to Japanese Patent Application No. JP 2010-138592, filed Jun. 17, 2010, the disclosure of which is incorporated herein by reference in its entirety.

BACKGROUND OF THE INVENTION

1. Field of the Invention

The present invention relates to inkjet recording treatment liquids, inkjet cartridges, inkjet recordings, ink jet recording ink sets, and inkjet recording methods.

2. Discussion of the Background

Recently, inkjet printers have rapidly come into wide use, because such printers can print on regular paper, are easily used for colorization, are compact and inexpensive, and can be operated at relatively low cost.

On the other hand, inkjet printing often results in image defects, such as character feathering (hereinafter referred to as feathering), which can be attributed to certain ink compositions. Attempts to reduce feathering may involve suppressing ink permeability. However, suppression of ink permeability generally causes poor driability. As a result, when a user touches an image after printing, the image smears.

In inkjet printing, color images are printed by superimposing different colors of over one another. This process can result in bleeding of color ink at a color boundary portion of an image or non-uniform mixing of color inks (hereinafter referred to as color bleeding). These phenomena substantially decrease image quality. Attempts to address color bleeding may involve increasing ink permeability. However, suppression of ink permeability generally affects color ink so that the ink more easily enters into the recording medium. This, in turn, decreases image density and may cause the ink to permeate through to the back side of the recording medium. As a result, two-sided printing may not be suitably performed.

Attempts to address feathering and color bleeding have included image forming methods employing both an ink and a treatment liquid. While such methods have attempted to increase image quality, problems have arisen, including decreased driability of images and smearing, and unevenness in image density.

JP2004-142291 discloses a method in which a treatment liquid is dispensed onto a recording medium along with ink from an inkjet head. JP2004-330569 discloses a method in which a treatment liquid is sprayed onto a recording medium using air pressure. JP2008-260307 discloses a method in which a treatment liquid is applied to a recording medium by controlling application pressure of a coating roller and a counter roller.

The method described in JP2004-142291 raises difficulties because the viscosity and surface tension of the treatment liquid must be managed to allow dispensing via an inkjet head which requires particular limitations with respect to, e.g., nozzle diameter. The resulting treatment liquids have decreased driability.

The method described in JP2004-330569 raises difficulties because additional space must be provided in an image forming device for dispensing treatment liquid. In addition, in comparison to coating methods, it is difficult to control the amount of treatment liquid that is dispensed when spraying.

The method described in JP2008-260307 provides an insufficient improvement of feathering and color bleeding.

SUMMARY OF THE INVENTION

The present invention addresses the problems of feathering and color bleeding in a manner not possible in prior methods. An object of the present invention is to provide an inkjet recording treatment liquid which can be used in image forming methods to produce images having high image density and saturation by reducing ooze.

In various exemplary embodiments, inkjet recording treatment liquids according to the present invention includes: at least one water-soluble organic solvent; water; at least one compound according to formula (I)

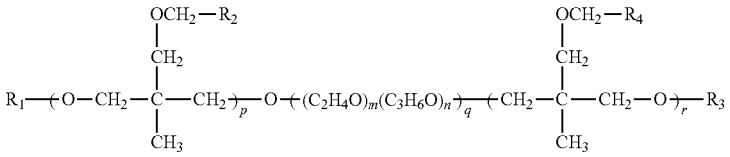

wherein: each of $R_1$ and $R_3$ independently represents H, a lower alkoxy group, or a lower perfluoroalkoxy group; each of $R_2$ and $R_4$ independently represents a lower perfluoroalkyl group; each of p, q, and r is independently an integer of 1 to 24; m is an integer of 1 to 28; and n is an integer of 0 to 10; and at least one compound according to formula (II)

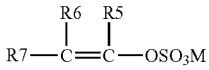

wherein: each of R5, R6, and R7 independently represents a lower alkyl group, a lower perfluoroalkoxy group, or F; and M is Li, Na, or K.

In various exemplary embodiments, methods of inkjet recording according to the present invention include: applying an inkjet recording treatment liquid according to the present invention to a recording medium; and discharging ink from an inkjet printhead onto the recording medium.

In various exemplary embodiments, inkjet recording apparatus according to the present invention include: a receptacle for storing an inkjet recording treatment liquid according to the present invention; a receptacle for storing an ink; means for applying the inkjet recording treatment liquid to a recording medium; and means for discharging the ink onto the recording medium.

In various exemplary embodiments, storage bags according to the present invention include: a bag formed from a flexible film; and an inkjet recording treatment liquid according to the present invention retained within the bag.

In various exemplary embodiments, cartridges according to the present invention include: a rigid cartridge body; and an inkjet recording treatment liquid according to the present invention retained within the cartridge body.

BRIEF DESCRIPTION OF THE DRAWINGS

A more complete appreciation of the invention and many of the attendant advantages thereof will be readily obtained as the same become better understood by reference to the following detailed description when considered in connection with the accompanying drawings, wherein.

DETAILED DESCRIPTION OF EXEMPLARY EMBODIMENTS

Inkjet Recording Treatment Liquid

Figure 1:
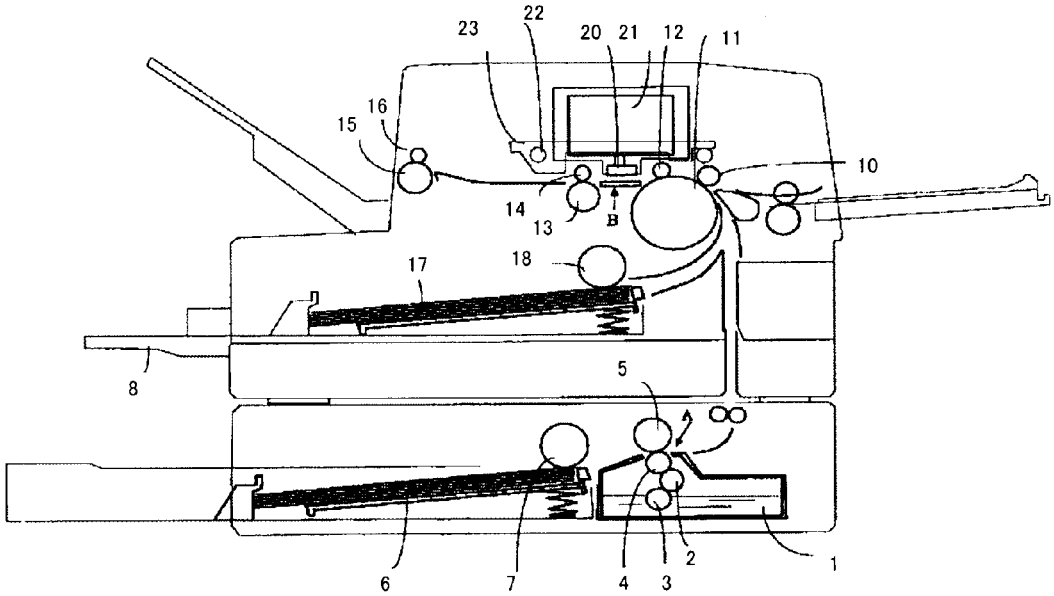
FIG. 1 is a cross-sectional side view of an exemplary apparatus according to the present invention.

In exemplary embodiments, inkjet recording treatment liquids according to the present invention include:

at least one water-soluble organic solvent;

water;

at least one compound according to formula (I)

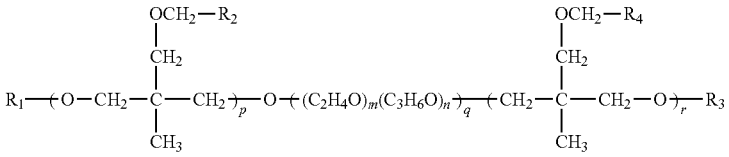

wherein:

each of $R_1$ and $R_3$ independently represents H, a lower alkoxy group, or a lower perfluoroalkoxy group;

each of $R_2$ and $R_4$ independently represents a lower perfluoroalkyl group, each of p, q, and r is independently an integer of 1 to 24;

m is an integer of 1 to 28; and n is an integer of 0 to 10; and at least one compound according to formula (II)

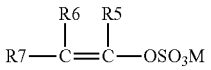

wherein:

each of R5, R6, and R7 independently represents a lower alkyl group, a lower perfluoroalkoxy group, or F; and M is Li, Na, or K.

Other components may also be included in the inkjet recording treatment liquids.

The compounds of formula (I) and formula (II) are fluorine surfactants. The fluorine surfactant of the compound of formula (I) is employed in exemplary inkjet recording treatment liquids to reduce formation of foam. The formation of foam relates to properties such as surface tension and viscosity. In liquids having high surface tension, such as water, decreases surface area are small so formation of foam is difficult. Generally, a treatment liquid including a fluorine surfactant would foam easily because of low surface tension, and it would be difficult to eliminate such foam. Generally, to eliminate foam, it is necessary to reduce the surface tension of the foam membrane, e.g., by employing a foam-restraining agent.

However, when a fluorine surfactant having surface tension-reducing ability is employed, it is not necessary to employ a foam-restraining agent. This is desirable because the difficulties associated with undissolved foam-restraining agents and/or undesired evaporation of the treatment liquid may be avoided.

The present inventors discovered that fluorine surfactants of the compound of formula (I) are effective in enhancing wettability of paper because of the reduced surface tension of such surfactants. Such surfactants are also effective in achieving leveling between air and liquid. Moreover, the surfactants are effective in limiting foam formation.

The present inventors further discovered that fluorine surfactants of the compound of formula (II) react with the colorant component of inks, function as flocculants, and enhance permeability and wettability of paper. The mechanism by which the surfactant interacts with colorants is not known, but is hypothesized to involve an acid-base reaction.

Pigments are preferably used as colorants in inks that are discharged onto recording media treated with the inkjet recording treatment liquids of the present invention. Such pigments preferably have the structure of polymer fine particles. By using the treatment liquids described herein and inkjet recording inks including pigments as colorants, it is possible to promote aggregation between treatment liquid and colorant component.

In the compound of formula (I), each of p, q, and r is preferably 1 to 24, and more preferably 1 to 4. m is preferably 1 to 28, and more preferably is 10 to 21. n is preferably 0 to 10. The lower alkoxy groups of $R_1$ and $R_3$ preferably include 1 to 4 carbon atoms, and more preferably are selected from $—OCH_3$ and $—OC_2H_5$. The lower perfluoroalkoxy groups of $R_1$ and $R_3$ preferably include 1 to 4 carbon atoms, and more preferably are selected from $—OCF_3$, $—OC_2F_5$, $—OC_3F_7$, $—OC_4F_9$.

The lower perfluoroalkyl groups of $R_2$ and $R_4$ preferably include 1 to 4 carbon atoms, and more preferable are selected from $—CF_3$, $—C_2F_5$, $—C_3F_7$, $—C_4F_9$.

In the compound of formula (II), the lower alkyl groups of $R_5$ to $R_7$ preferably include 1 to 4 carbon atoms, and more preferably are selected from $—CH_3$, $—C_2H_5$, $—C_3H_7$, $—C_4H_9$.

The lower perfluoroalkoxy groups of $R_5$ to $R_7$ preferably include 1 to 4 carbon atoms, and more preferably are selected from $—OCF_3$, $—OC_2F_5$, $—OC_3F_7$, $—OC_4F_9$.

The amount of the fluorine surfactant of the compound of formula (I), as a solid, in exemplary inkjet recording treatment liquids according to the present invention is preferably 0.01% by mass to 10% by mass, and more preferably 0.1% by mass to 5% by mass.

Employing the fluorine surfactant of the compound of formula (I) in amounts of less than 0.01% by mass may prevent sufficient foam reduction. Employing the fluorine surfactant of the compound of formula (I) in amounts of more than 10% by mass, may result in increased viscosity, reduced ability to constrain foamability, an adverse effect on chargeability, and formation of air bubbles in inkjet printheads.

The amount of the fluorine surfactant of the compound of formula (II), as a solid, in exemplary inkjet recording treatment liquids according to the present invention is preferably 5% by mass to 30% by mass.

Employing the fluorine surfactant of the compound of formula (II) in amounts of less than 5% by mass may result in insufficient aggregation of colorant in the ink. Employing the fluorine surfactant of the compound of formula (II) in amounts of more than 30% by mass may result in increased viscosity, an adverse effect on chargeability, and formation of air bubbles in inkjet printheads.

Commercially available fluorine surfactants may be used along with the fluorine surfactants of the compound of formula (I) and the compound of formula (II) may also be used in exemplary inkjet recording treatment liquids according to the present invention.

Nonionic surfactants, anionic surfactants, ampholytic surfactants, acetylenic surfactants, and glycolic surfactants may also be used in exemplary inkjet recording treatment liquids according to the present invention.

Examples of commercially available products include SURFLON S-111, S-112, S-113, S-121, S-131, S-132, S-141, S-145 (manufactured by Asahi Glass Co., Ltd), FLORARD FC-93, FC-95, FC-98, FC-129, FC-135, FC-170C, FC-430, FC-431 (manufactured by Sumitomo 3M Limited), MEGAFAC F-470, F1405, and F-474 (manufactured by DIC Corporation), ZONYL FS-300, FSN, FSN-100, FSO (manufactured by DuPont), EFTOP EF-351, EF-352, EF-801, and EF-802 (by JEMCO Inc). Among them, ZONYL FS-300, FSN, FSN-100, and FSO (by DuPont Kabushiki Kaisha) are particularly preferable in view of excellent reliability and improved color development.

<Water-Soluable Organic Solvent (Wetting Agent)>

Exemplary inkjet recording treatment liquids according to the present invention include water-soluble organic solvents. Examples of water-soluble organic solvents include polyhydric alcohols, polyhydric alcohol alkylethers, polyhydric alcohol arylethers, nitrogen-containing heterocyclic compounds, amides, amines, sulfur-containing compounds, propylene carbonate, ethylene carbonate.

Exemplary water-soluble organic solvents have a high equilibrium moisture content. This attribute may maintain moisture of the treatment liquid and, in turn maintain flowability. Thus, extreme increases of viscosity of the treatment liquid are avoided.

In embodiments, the equilibrium moisture content of the water soluble organic solvent is 30% by mass or more at a temperature of 23° C. and a relative humidity of 80%. In preferred embodiments, the equilibrium moisture content of the water soluble organic solvent is 40% by mass or more at a temperature of 23° C. and a relative humidity of 80%.

In embodiments, the equilibrium moisture content of the water soluble organic solvent is such that, when a mixture of the water-soluble organic solvent and water is maintained at constant temperature and constant humidity there is equilibrium between the amount of evaporation of water from the solution and the amount of absorption of such water to ink.

Equilibrium moisture content may be determined by placing 1 g of a water soluble organic solvent in a a desiccator that is maintained at a temperature of 23±1° C. and a relative humidity of 80±3% using a saturated aqueous solution of potassium chloride, and determining the saturated water content of the water soluble organic solvent.

Saturated water content(%)=(mass of water absorbed in the organic solvent/mass of the organic solvent)×100.

In embodiments, inkjet recording treatment liquids according to the present invention may include a first water soluble organic solvent and optionally a second or further water soluble organic solvent. In embodiments, the first water soluble organic solvent includes at least one polyhydric alcohol having an equilibrium moisture content of 30% by mass or more in an atmosphere having a temperature of 23° C. and a relative humidity of 80%.

Exemplary polyhydric alcohols used as the first solvent include 1,2,3-butanetriol (BP: 175° C./33 hPa 38% by mass), 1,2,4-butanetriol, (BP: 190° C./24 hPa to 191° C./24 hPa, 41% by mass), glycerin (BP: 290° C., 49% by mass), diglycerin (BP: 270° C./20 hPa, 38% by bmass), triethylene glycol (BP: 285° C., 39% by mass), and tetraethylene glycol (BP: 324° C. to 330° C., 37% by mass), diethylene glycol (BP: 245° C., 43% by mass), and 1,3-butandiol (BP: 203° C. to 204° C., 35% by mass).

Glycerin and 1,3-butanediol are particularly preferred because, when such solvents include moisture, viscosity of the solvents decreases and pigments may be dispersed in the solvents without aggregation.

In embodiments, the water soluble organic solvent includes the first water soluble organic solvent in an amount of 50% by mass or more relative to a total mass of the water-soluble organic solvent. Employing the first water soluble organic solvent is such amounts provides excellent discharge stability and prevention of adhesion of waste ink to discharging apparatus.

In embodiments of inkjet recording treatment liquids according to the present invention, the first water soluble organic solvent is combined with the second water soluble organic solvent having an equilibrium moisture content of 30% by mass or more in an atmosphere having a temperature of 23° C. and a relative humidity of 80%.

Exemplary second water soluble organic solvents include polyhydric alcohols, polyhydric alcohol alkylethers, polyhydric alcohol arylethers, nitrogen-containing heterocyclic compounds, amides, amines, sulfur-containing compounds, propylene carbonate, and ethylene carbonate.

Exemplary polyhydric alcohols employed as the second water soluble organic solvent include dipropylene glycol (BP: 232° C.), 1,5-pentandiol (BP: 242° C.), 3-methyl-1,3-butanediol (BP: 203° C.), propylene glycol (BP: 187° C.), 2-methyl-2,4-pentanediol (BP: 197° C.), ethylene glycol (BP: 196° C. to 198° C.), tripropylene glycol (BP: 267° C.), hexylene glycol (BP: 197° C.), polyethylene glycol (viscous liquid to solid), polypropylene glycol (BP: 187° C.), 1,6-hexanediol (BP: 253° C. to 260° C.), 1,2,6-hexanetriol (BP: 178° C.), trimethylolethane (solid, MP: 199° C. to 201° C.), and trimethylolpropane (solid, MP: 61° C.).

Exemplary polyhydric alcohol alkyl ethers employed as the second water soluble organic solvent include ethylene glycol monoethyl ether (BP: 135° C.), ethylene glycol monobutyl ether (BP: 171° C.), diethylene glycol monomethyl ether (BP: 194° C.), diethylene glycol monoethyl ether (BP: 197° C.), diethylene glycol monobutyl ether (BP: 231° C.), triethylene glycol mono-2-ethylhexyl ether (BP: 229° C.), and propylene glycol monoethyl ether (BP: 132° C.).

Exemplary polyhydric alcohol aryl ethers employed as the second water soluble organic solvent include ethylene glycol monophenyl ether (BP: 237° C.) and ethylene glycol monobenzyl ether.

Exemplary nitrogen-containing heterocyclic compounds employed as the second water soluble organic solvent include 2-pyrrolidone (BP: 250° C., mp 25.5° C., 47 to 48% by mass), N-methyl-2-pyrrolidone (BP: 202° C.), 1,3-dimethyl-2-imidazolidinone (BP: 226° C.), ε-caprolactam (BP: 270° C.), and γ-butyrolactone (BP: 204° C. to 205° C.).

Exemplary amides employed as the second water soluble organic solvent include formamide (BP: 210° C.), N-methylformamide (BP: 199° C. to 201° C.), N,N-dimethyl formamide (BP: 153° C.), and N,N-diethyl formamide (BP: 176° C. to 177° C.).

Exemplary amines employed as the second water soluble organic solvent include monoethanolamine (BP: 170° C.), diethanolamine (BP: 268° C.), triethanolamine (BP: 360° C.), N,N-dimethyl monoethanolamine (BP: 139° C.), N-methyldiethanolamine (BP: 243° C.), N-methylethanolamine (BP: 159° C.), N-phenylethanolamine (BP: 282° C. to 287° C.), and 3-aminopropyldimethylamine (BP: 169° C.).

Exemplary sulfur compounds employed as the second water soluble organic solvent include dimethylsulfoxide (BP: 139° C.), sulfolan (BP: 285° C.), and thiodiglycol (BP: 282° C.).

In addition or alternative to the water soluble organic solvents identified above, saccharides may also be employed in the inkjet recording treatment liquids according to the present invention.

Exemplary saccharides include monosaccharides, disaccharides, oligosaccharides (including trisaccharides and tetrasaccharides), and polysaccharides. More specifically, exemplary saccharides may include glucose, mannose, fructose, ribose, xylose, arabinose, galactose, maltose, cellobiose, lactose, sucrose, trehalose, and maltotriose.

As used herein, the term polysaccharides refers to sugars in a broad sense and may include substances widely present in nature, such as α-cyclodextrin and cellulose.

Derivatives of saccharides may also be employed. Exemplary derivatives of saccharides include reduced sugars of saccharides (for example, sugar alcohol, expressed by a general formula $HOCH_2(CHOH)_nCH_2OH$, where n represents an integer of 2 to 5), oxidized sugars (for example, aldonic acid and uronic acid), amino acids, and thio acids. Of these, sugar alcohols are preferred. Exemplary sugar alcohols include maltitol and sorbitol.

Water soluble organic solvents may be employed in the inkjet recording treatment liquids according to the present invention in any suitable amount. In embodiments, the water soluble organic solvents are employed in an amount of 10 to 80% by mass, preferably 15 to 60% by mass, based on a total mass of an inkjet recording treatment liquid.

When the water soluble organic solvents are employed in an amount of more than 80% by mass, it may be difficult to obtain drying after the inkjet recording treatment liquid is applied to a recording medium. When the water soluble organic solvents are employed in an amount of less than 10% by mass, evaporation of moisture may occur during the coating process or thereafter, thus resulting in undesirable changes to the composition of the treatment liquid.

<Aliphatic Organic Acid Salt Compounds and Inorganic Metal Salt Compounds>

In addition to the components identified above, exemplary inkjet recording treatment liquids according to the present invention may include at least one of aliphatic organic acid salt compounds and inorganic metal salt compounds. When such compounds are employed, the capability of pigments to collect on a surface of a surface of recording medium is increased and image density is improved.

Exemplary aliphatic organic acid salt compounds include L-aspartic acid sodium, L-aspartic acid magnesium, ascorbic acid calcium, L-ascorbic acid sodium, succinic acid sodium, two succinic acid sodium, two succinic acid ammonium, citric acid aluminum, potassium citrate, citric acid calcium, three citric acid ammonium, three citric acid potassium, three citric acid sodium, two citric acid ammonium, two citric acid sodium, lactic acid zinc, lactic acid aluminum, lactic acid ammonium, lactic acid potassium, lactic acid calcium, sodium lactate, lactic acid magnesium, tartaric acid potassium, tartaric acid calcium, DL-tartaric acid sodium, and tartaric acid sodium potassium Exemplary inorganic metal salt compounds include magnesium sulphate, aluminium sulfate, manganese sulfate, nickel sulfate, iron (II) sulfate, copper (II) sulfate, zinc sulfate, iron (II) nitrate, iron (III) nitrate, cobalt nitrate, strontium nitrate, copper (II) nitrate, nickel (II) nitrate, lead (II) nitrate, manganese (II) nitrate, nickel (II) chloride, calcium chloride, tin (II) chloride, strontium chloride, barium chloride, magnesium chloride, and water-soluble monovalent alkali metal salts.

Exemplary water-soluble monovalent alkali metal salts include sodium sulfate, potassium sulfate, lithium sulfate, sodium bisulfate, potassium bisulfate, sodium nitrate, potassium nitrate, sodium carbonate, potassium carbonate, $NaHCO_3$, potassium hydrogen carbonate, sodium chloride, and potassium chloride.

Aliphatic organic acid salt compounds and inorganic metal salt compounds may be employed in the inkjet recording treatment liquids according to the present invention in amounts of from 0.1% by mass to 30% by mass relative to a total mass of treatment liquid. More preferably, aliphatic organic acid salt compounds and inorganic metal salt compounds may be employed in the inkjet recording treatment liquids according to the present invention in amounts of from 0.1% by mass to 20% by mass relative to a total mass of treatment liquid.

When aliphatic organic acid salt compounds and inorganic metal salt compounds may be employed in the inkjet recording treatment liquids according to the present invention in amounts of more than 30% by mass, such compounds may not be sufficiently soluble sufficiently and deposition may occur. When aliphatic organic acid salt compounds and inorganic metal salt compounds may be employed in the inkjet recording treatment liquids according to the present invention in amounts of less than 0.1% by mass, the treatment liquid may have an insufficient effect in increasing image density.

<Other Components>

Inkjet recording treatment liquids according to the present invention may include other components.

In embodiments, inkjet recording treatment liquids according to the present invention may include one or more penetrants. Exemplary penetrants include polyols having from 8 to 11 carbon atoms and glycolethers. Other penetrants that are soluble in water and possess desired properties may also be employed.

In embodiments, exemplary penetrants may have a solubility of 0.2% by mass to 5.0% by mass in water at 25° C. Such penetrants may include compounds such as 2-ethyl-1,3-hexanediol [solubility: 4.2% (25° C.)] and 2,2,4-trimethyl-1,3-pentanediol [solubility: 2.0% (25° C.)].

Exemplary polyols include 2-ethyl-2-methyl-1,3-propanediol, 3,3-dimethyl-1,2-butanediol, 2,2-diethyl-1,3-propanediol, 2-methyl-2-propyl-1,3-propanediol, 2,4-dimethyl-2,4-pentanediol, 2,5-dimethyl-2,5-hexanediol, and 5-hexene-1,2-diol.

Exemplary glycolethers include diethylene glycol phenyl ether, ethylene glycol phenyl ether, ethylene glycol allyl ether, diethylene glycol phenyl ether, diethylene glycol butyl ether, propylene glycol butyl ether, and tetraethylene glycol chlorophenyl ether.

Lower alcohols, such as ethanol may also be employed as penetrants.

Penetrants may preferably be employed in the inkjet recording treatment liquids according to the present invention in amounts of from 0.1% by mass to 5.0% by mass relative to a total mass of the inkjet recording treatment liquid.

When penetrants are employed in the inkjet recording treatment liquids according to the present invention in amounts of less than 0.1% by mass, the penetrability of inkjet recording ink into a treated recording medium is reduced. When penetrants are employed in the inkjet recording treatment liquids according to the present invention in amounts of more than 5.0% by mass, the penetrants are insufficiently soluble in the treatment liquid and may separate.

In addition to penetrants, inkjet recording treatment liquids according to the present invention may also include other agents, such as antiseptic agents, antirust agents, and the like.

<Inkjet Recording Ink>

Any suitable inkjet recording ink may be used with the inkjet recording treatment liquid according to the present invention. In various exemplary embodiments, inks may include a water dispersible colorant, a water soluble organic solvent, a surfactant, a penetrant, and water. Other components may also be included.

<Water Dispersible Colorant>

In embodiments, a pigment is used as a water dispersible colorant to provide good weather resistance. In embodiments, a dye may be used to adjust color tone in amounts that do not compromise weather resistance.

Any suitable pigment may be employed. Exemplary pigments include inorganic and organic pigments for black and for color. Such pigments may be used alone or in combination.

Exemplary inorganic pigments include titanium oxide, iron oxide, calcium carbonate, barium sulfate, aluminum hydroxide, barium yellow, cadmium red, and chromium yellow. Additionally, carbon black, which is produced by known methods such as contact methods, furnace methods and thermal methods, can be used.

Exemplary organic pigments include azo pigments, such as azo lakes, insoluble azo pigments, condensed azo pigments, and chelate azo pigments; polycyclic pigments such as phthalocyanine pigments, perylene pigments, perinone pigments, anthraquinone pigments, quinacridone pigments, dioxadine pigments, indigo pigments, thioindigo pigments, isoindolinone pigments and quinophthalone pigments; dye chelates, such as basic dye chelates and acidic dye chelates; nitro pigments, nitroso pigments, and aniline black. Of these, pigments having hydrophilic nature are preferably used.

More particular examples of pigments include the following:

Examples of pigments for black include carbon black (C.I. pigment black 7) such as furnace black, lamp black, acetylene black and channel black; metal such as copper, iron (C.I. pigment black 11) and titanium oxide; organic pigments such as aniline black (C.I. pigment black 1).

Examples of pigments for colors other than black include C.I. pigment yellow 1, 3, 12, 13, 14, 17, 24, 34, 35, 37, 42 (yellow iron oxide), 53, 55, 74, 81, 83, 95, 97, 98, 100, 101, 104, 408, 109, 110, 117, 120, 128, 138, 150, 151, 153, 183; C.I. pigment orange 5, 13, 16, 17, 36, 43, 51; C.I. pigment red 1, 2, 3, 5, 17, 22, 23, 31, 38, 48:2 (permanent red 2B (Ca)), 48:3, 48:4, 49:1, 52:2, 53:1, 57:1 (brilliant carmine 6B), 60:1, 63:1, 63:2, 64:1, 81, 83, 88, 101 (colcothar), 104, 105, 106, 108 (cadmium red), 112, 114, 122 (quinacridone magenta), 123, 146, 149, 166, 168, 170, 172, 177, 178, 179, 185, 190, 193, 209, 219; C.I. pigment violet 1 (rhodamine lake), 3, 5:1, 16, 19, 23, 38; C.I. pigment blue 1, 2, 15, 15:1, 15:2, 15:3 (phthalocyanine blue), 16, 17:1, 56, 60, 63; and C.I. pigment green 1, 4, 7, 8, 10, 17, 18, 36.

Preferred embodiments employing a pigment as a colorant include the following:

1) In a first embodiment, the colorant contains a polymer emulsion which is composed of fine polymer particles containing a water-insoluble and/or hardly water-soluble colorant (an aqueous dispersion of fine polymer particles containing a colorant, i.e. resin coated pigment).

2) In a second embodiment, a colorant contains a pigment which has at least one hydrophilic group at its surface and is water-dispersible in the absence of a dispersant (hereinafter, referred to as "self-dispersible pigment").

When preparing an ink according to the second embodiment above, it may be necessary to employ a water-dispersible resin as described below.

Water-dispersible colorants of the first embodiment above may also include a polymer emulsion composed of fine polymer particles containing a pigment. The polymer emulsion composed of fine polymer particles each containing a pigment is a fine polymer particle in which a pigment is encapsulated and/or a fine polymer particle to the surface of which a pigment is adhered. In such case, all the pigments are not necessarily encapsulated and/or adhered, and the pigment may be dispersed in the emulsion within a certain amount in which the effect of the present invention will not be compromised. The polymers for forming the polymer emulsion (i.e. the polymers in the fine polymer particles) include vinyl polymers, polyester polymers, and polyurethane polymers. The polymers preferably used are vinyl polymers and polyester polymers. Such polymers are disclosed in, for example, JP-A No. 2000-53897 and JP-A No. 2001-139849.

Self-dispersible pigments of the second embodiment above include surface-treated pigments such that at least a hydrophilic group bonds directly or through another atomic group to the surface of the pigment. The surface-treatment may be carried out by way of chemically bonding a certain functional group such as sulfonic group and carboxyl group to the surface of pigments or wet-oxidizing pigments either with hypohalous acids or their salts. Particularly preferable are water-dispersible pigments to which surface a carboxyl group bonds. Such surface-treatment with a carboxyl group may improve dispersion stability, provide high-quality printing and increase water resistance of recording media after printing.

In addition, inks containing self-dispersible pigments of the first embodiment above may exhibit superior re-dispersibility even after drying. As a result, substantially no clogging of nozzles will occur even after a long-term rest and evaporation of moisture of the ink around ink-jet head nozzles has occurred. Thus, proper printing may be easily resumed after simple cleaning.

Preferably, self-dispersible pigments have a volume average particle diameter (D50) of 0.01 μm to 0.16 μm in the ink.

As a self-dispersible carbon black, those exhibiting ionic properties are preferred, and those having an anionic or cationic charge are more preferred.

Examples of the anionic hydrophilic groups include —COOM, —$SO_3M$, —$PO_3HM$, —$PO_3M_2$, —$SO_2NH_2$, and —$SO_2NHCOR$, in which M represents a hydrogen atom, an alkaline metal, an ammonium or organic ammonium; R represents an alkyl group having carbon atoms of 1 to 12, a phenyl group which may be substituted by a substituent, and a naphthyl group which may be substituted by a substituent. Of these, preferred are color pigments to which surface —COOM or —$SO_3M$ bonds.

Exemplary alkaline metals represented by M include lithium, sodium, and potassium. Exemplary organic ammoniums include mono- or tri-methyl ammonium, mono- or tri-ethyl ammonium, and mono or tri-methanol ammonium. As for methods for producing the anionically charged color pigments, —COONa may be introduced on the surface of color pigments by way of, for example, oxidization-treating color pigments using sodium hypochlorite, sulfonating, or reacting with a diazonium salt.

Hydrophilic groups may be attached to the surface of carbon black through another atomic group. The other atomic group may include alkyl groups having from 1 to 12 carbon atoms, phenyl groups which may be substituted by a substituent, and naphthyl groups which may be substituted by a substituent. Specific examples of hydrophilic groups bonded via other atomic groups attached to the surface of carbon black are —$C_2H_4COOM$ (M represents an alkaline metal or quaternary ammonium), -$PhSO_3M$ (Ph represents a phenyl group, and M represents an alkaline metal or quaternary ammonium).

The amount of colorant is preferably 2% by mass to 15% by mass, and more preferably 3% by mass to 12% by mass, relative to a total mass of the recording ink on the basis of solid content. When the amount is less than 2% by mass, color development of ink and image density may be significantly decreased. When the amount is more than 15% by mass, the ink viscosity may be increased excessively, causing poor discharge ability. Moreover, amounts in excess of 15% by mass are not economically desirable.

<Water Soluble Organic Solvent>

Although any suitable water soluble organic solvent may be used in the inks described herein, water soluble organic solvents employed in the inkjet recording treatment liquids described above are preferred.

A weight ratio between water dispersible colorants and water soluble organic solvents in an ink affect to charge stability of ink from an inkjet printhead.

For example, if an amount of water dispersible colorant is high, but an amount of water soluble organic solvent is low, evaporation of water at a location of the meniscus of an inkjet printhead may increase, which may adversely affect ink discharge.

Accordingly, an amount of water soluble organic solvent in the ink is preferably 20% by mass to 50% by mass, and more preferably 20% by mass to 45% by mass, relative to a total mass of the ink.

When an amount of water soluble organic solvent in the ink is less than 20% by mass, discharge stability may be reduced, and waste ink may adhere to printing equipment. When an amount of water soluble organic solvent in the ink is more than 50% by mass, the ability of the ink to dry on a paper surface is decreased, and print quality is reduced.

Exemplary water soluble organic solvents include glycerin, trimethylol propane, ethylene glycol, diethylene glycol, triethylene glycol, propylene glycol, dipropylene glycol, tripropylene glycol, 1,2-butanediols, 1,2-pentanediols, 1,2-hexanediols, 1,2-octane diol, 1,3-butanediols, 2,3-butanediols, 1,4-butanediols, 3-methyl-1,3-butanediols, 1,5-pentanediols, 1,6-hexanediols, 2-methyl-2,4-hexanediols, two-pyrrolidones, N-methyl-2-pyrrolidone, N-hydroxyethyl-2-pyrrolidone, tetramethyl urea, and urea.

<Surfactant>

Exemplary inks may include surfactants. Exemplary surfactants include at least of anionic surfactants, nonionic surfactants, silicone surfactants, and fluorine surfactants. Employing surfactants allows for lower surface tension, higher permeability, and higher leveling ability, without diminishing dispersion stability when used in combination with various colorants and water-soluble organic solvents. Silicone surfactants and fluorine surfactants are particularly preferred.

The various surfactants identified above may be used alone or in combination.

Although any surfactants may be used in the inks described herein, surfactants employed in the inkjet recording treatment liquids described above are preferred.

An amount of surfactant in the ink is preferably 0.01% by mass to 3.0% by mass, and more preferably 0.5% by mass to 2.0% by mass, relative to a total mass of the ink.

When an amount of surfactant in the ink is less than 0.01% by mass, the beneficial effects associated with the surfactant may not be exhibited. When an amount of surfactant in the ink is more than 3.0% by mass, penetrability may be higher than necessary, which can reduce image density and result in strike through.

<Penetrant>

Exemplary inks may include penetrants.

An amount of penetrant in the ink is preferably 0.1% by mass to 4.0% by mass. When the amount is less than 0.1% by mass, drying speed may be lower, which may result in image bleeding. When the amount is more than 4.0% by mass, dispersion stability of the colorant may be impaired, nozzle clogging may easily occur, and permeability of the ink into a recording medium becomes excessively high, causing decrease of image density and strike through.

<Water-Dispersible Resin>

Exemplary inks may include water-dispersible resins. Exemplary water-dispersible resins include resins having excellent film-forming ability or image-forming ability, excellent water repellency, water resistance and weather resistance, so as to achieve high density images having excellent color development and water resistance. Exemplary water-dispersible resins include condensed synthetic resins, addition synthetic resins, and natural polymer compounds.

Exemplary condensed synthetic resins include polyester resins, polyurethane resins, polyepoxy resins, polyamide resins, polyether resins, poly(meth)acrylic resins, acrylic silicone resins, and fluorine resins.

Exemplary addition synthetic resins include polyolefin resins, polystyrene resins, polyvinyl alcohol resins, polyvinyl ester resins, polyacrylic resins, and unsaturated carboxylic acid resins.

Exemplary natural polymer compounds include celluloses, rosins, and natural rubbers.

Of these, polyurethane fine resin particles, acryl-silicone fine resin particles, and fluorine fine resin particles are preferred. Water-dispersible resins may be used alone or in combination.

Preferred fluorine resins include fluorine fine resin particles having a fluoroolefin unit. Of such fluorine resin particles, fluorine-containing vinyl ether fine resin particles composed of fluoroolefin units and vinyl ether units are particularly preferred.

Fluoroolefin units are not particularly limited and may be appropriately selected depending on the purpose. Examples of fluoroolefin units include —$CF_2CF_2$—, —$CF_2CF(CF_3)$— and —$CF_2CFCl$—.

Vinyl ether units are not particularly limited and may be appropriately selected depending on the purpose. Examples of vinyl ether units include compounds expressed by the following structural formulas.

Structure Formula(III)

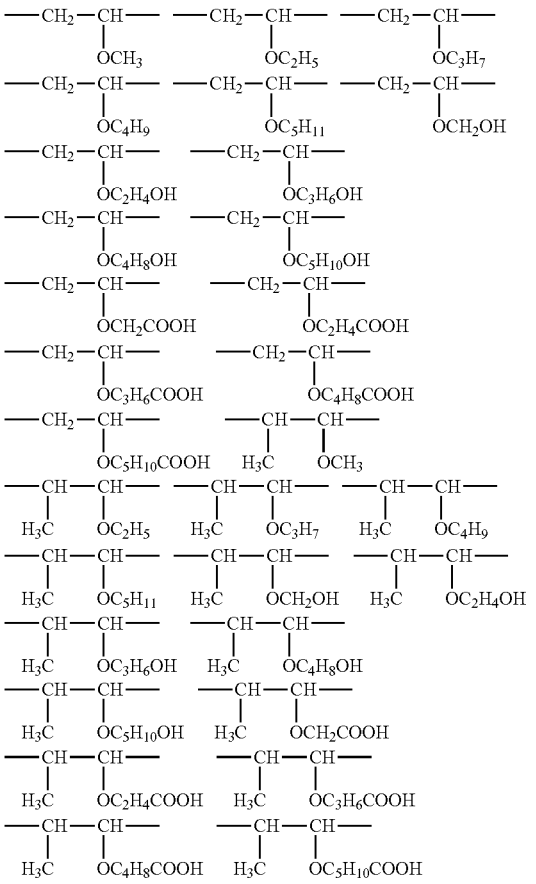

Fluorine-containing vinyl ether fine resin particles composed of fluoroolefin units and vinyl ether units are preferably alternating copolymers of fluoroolefin units and vinyl ether units.

As such fluorine resin particles, appropriately synthesized or commercially available products may be used.

Exemplary commercially available products include FLUONATE FEM-500 and FEM-600, DICGUARD F-52S, F-90, F-90M and F-90N, and AQUAFLUN TE-5A (all manufactured by DIC CORPORATION); LUMIFLON FE4300, FE4500 and FE4400, and ASAHI GUARD AG-7105, AG-950, AG-7600, AG-7000 and AG-1100 (all manufactured by ASAHI GLASS CO., LTD.).

Water-dispersible resins may include homopolymers or resins that are copolymerized as parts of composite resins. Water-dispersible resins may include single phase structures, core-shell structures, and power-feed emulsions.

Water-dispersible resins may include resins having hydrophilic groups and being self-dispersible or resins itself having no dispersibility in which dispersibility is imparted by a surfactant or a resin having a hydrophilic group. Of these, ionomers of polyester resins and polyurethane resins, and emulsions of resin particles obtained by emulsification/suspension polymerization of unsaturated monomers are preferred. In cases of emulsification polymerization of unsaturated monomers, water-dispersible resins can be easily obtained because the resin emulsion is obtained by reacting in the water into which an unsaturated monomer, a polymerization initiator, a surfactant, a chain transfer agent, a chelating agent, and a pH adjusting agent have been added, and objective properties are easily produced because the resin constitution is easily changed.

Exemplary unsaturated monomers include unsaturated carboxylic acids, monofunctional or multifunctional (meth) acrylate ester monomers, (meth)acrylate amide monomers, aromatic vinyl monomers, vinyl cyan compound monomers, vinyl monomers, allyl compound monomers, olefin monomers, diene monomers, oligomers having unsaturated carbons. These may be used alone or in combination. Combinations of these monomers enable flexible modification of properties. Resin properties can be improved by a means of polymerization or graft-polymerization using oligomer polymerization initiator.

Exemplary unsaturated carboxylic acids include acrylic acid, methacrylic acid, itaconic acid, fumaric acid, and maleic acid.

Exemplary monofunctional (meth)acrylate ester monomers include methyl methacrylate, ethyl methacrylate, isopropyl methacrylate, n-butyl methacrylate, isobutyl methacrylate, n-amyl methacrylate, isoamyl methacrylate, n-hexyl methacrylate, 2-ethylhexyl methacrylate, octyl methacrylate, decyl methacrylate, dodecyl methacrylate, octadecyl methacrylate, cyclohexyl methacrylate, phenyl methacrylate, benzyl methacrylate, glycidyl methacrylate, 2-hydroxyethyl methacrylate, 2-hydroxypropyl methacrylate, dimethylaminoethyl methacrylate, methacryloxyethyltrimethyl ammonium salts, 3-methacryloxypropyl trimethoxysilane, methyl acrylate, ethyl acrylate, isopropyl acrylate, n-butyl acrylate, isobutyl acrylate, n-amyl acrylate, isoamyl acrylate, n-hexyl acrylate, 2-ethylhexyl acrylate, octyl acrylate, decyl acrylate, dodecyl acrylate, octadecyl acrylate, cyclohexyl acrylate, phenyl acrylate, benzyl acrylate, glycidyl acrylate, 2-hydroxyethyl acrylate, 2-hydroxypropyl acrylate, dimethylaminoethyl acrylate, and acryloxyethyltrimethyl ammonium salts.

Exemplary multifunctional (meth)acrylate ester monomers include ethylene glycol dimethacrylate, diethylene glycol dimethacrylate, triethylene glycol dimethacrylate, polyethylene glycol dimethacrylate, 1,3-butylene glycol dimethacrylate, 1,4-butylene glycol dimethacrylate, 1,6-hexanediol dimethacrylate, neopentyl glycol dimethacrylate, dipropylene glycol dimethacrylate, polypropylene glycol dimethacrylate, polybutylene glycol dimethacrylate, 2,2'-bis(4-methacryloxydiethoxyphenyl)propane, trimethylol propane trimethacrylate, trimethylol ethane trimethacrylate, polyethylene glycol diacrylate, triethylene glycol diacrylate, 1,3-butylene glycol diacrylate, 1,4-butylene glycol diacrylate, 1,6-hexanediol diacrylate, neopentyl glycol diacrylate, 1,9-nonanediol diacrylate, polypropylene glycol diacrylate, 2,2'-bis(4-acryloxypropyloxyphenyl)propane, 2,2'-bis(4-acryloxydiethoxyphenyl)propane trimethylol propane triacrylate, trimethylol ethane triacrylate, tetramethylol methane triacrylate, ditrimethylol tetraacrylate, tetramethylol methane tetraacrylate, pentaerythritol tetraacrylate, and dipentaerythritol hexaacrylate.

Exemplary (meth)acrylate amide monomers include acrylamide, methacrylamide, N,N-dimethylacrylamide, methylenebisacrylamide, and 2-acrylamide-2-methylpropane sulfonate.

Exemplary aromatic vinyl monomers include styrene, α-methylstyrene, vinyltoluene, 4-t-butylstyrene, chlorostyrene, vinyl anisole, vinyl naphthalene, and divinyl benzene.

Exemplary vinylcyan compound monomers include acrylonitrile and methacrylonitrile.

Exemplary vinyl monomers include vinyl acetate, vinylidene chloride, vinyl chloride, vinyl ether, vinyl ketone, vinyl pyrrolidone, vinyl sulfonic acid and salts thereof, vinyl trimethoxysilane, and vinyl triethoxysilane.

Exemplary allyl compound monomers include allyl sulfonic acid and salts thereof, allylamine, allyl chloride, diallylamine, and diallyldimethyl ammonium salts.

Exemplary olefin monomers include ethylene and propylene.

Exemplary diene monomers include butadiene and chloroprene.

Exemplary oligomers having an unsaturated carbon include styrene oligomers having a methacryloyl group, styrene-acrylonitrile oligomers having a methacryloyl group, methyl methacrylate oligomers having a methacryloyl group, dimethylsiloxane oligomers having a methacryloyl group, and polyester oligomers having an acryloyl group.

Since breakdowns of the molecular chain, including dispersion breaking and hydrolysis, are caused in a strong alkaline or acidic environment, pH of the water-dispersible resin is preferably 4 to 12. In particular, in terms of miscibility with a water-dispersible colorant, pH is more preferably 6 to 11, and still more preferably 7 to 9.

An average particle diameter (D50) of a water dispersible resin emulsion in a water dispersion is preferably 10 nm to 300 nm, and more preferably 40 nm to 200 nm.

When an average particle diameter (D50) is less than 10 nm, viscosity of a resin solution increases. If an ink is prepared using such a water-dispersible resin, it may difficult to discharge such an ink via an inkjet printhead.

When an average particle diameter (D50) is greater than 300 nm, particles may become blocked in an in inkjet printhead.

Water-dispersible resins preferably operate to fix water-dispersible colorants onto paper, and form films at room temperature so as to improve the fixability of the colorant. Therefore, it is preferred that a minimum film-forming temperature (MFT) of the water-dispersible resin be 30° C. or less. A glass transition temperature of the water-dispersible resin is preferably −30° C. or more, because when the glass transition temperature is −40° C. or less, the viscosity of the resin film increases, resulting in the generation of wrinkles on printed paper.

An amount of the water-dispersible resin in the ink is preferably 1% by mass to 15% by mass and more preferably 2% by mass to 7% by mass, based on solid content.

Solid contents of the colorant, the pigment in the colorant and the water-dispersible resin may be measured, for example, by means of separating colorant and water-dispersible resin components from the ink. And when a pigment is used as the colorant, the proportion of the colorant and water-dispersible resin can be determined based on a mass reduction ratio obtained by thermal mass analysis. When a colorant is, for example, a pigment or a dye, and its molecular structure is known, the solid content of the colorant can be determined by nuclear magnetic resonance analysis, or NMR. When the colorant is, for example, an inorganic pigment contained in a heavy metal atom or molecular frame, a metal-containing organic pigment or a metal-containing dye, and its molecular structure is known, the solid content of the colorant can be determined by X-ray fluorescence analysis.

<Other Components>

Exemplary inks may include other components. Such other components are not particularly limited and may be appropriately selected depending on the purpose. Exemplary other components include pH adjusting agents, antiseptic/antifungal agents, chelating reagents, antirust agents, antioxidants, UV absorbers, oxygen absorbers, and photostabilizers.

pH adjusting agents are not particularly limited as long as such agents have no adverse effects on the recording ink and can adjust pH within a range of from 7 to 11. Suitable pH adjusting agents may be selected depending on the purpose. Exemplary pH adjusting agents include alcohol amines, alkali metal hydroxides, ammonium hydroxides, phosphonium hydroxides, and alkali metal carbonates. When a pH is less than 7 or more than 11, materials forming inkjet printheads and ink-supply units may be dissolved, which may lead to degradation or leakage of the ink, inferior ink-ejection, and the like.

Exemplary alcohol amines include diethanolamine, triethanolamine, and 2-amino-2-ethyl-1,3-propanediol.

Exemplary alkali metal hydroxides include lithium hydroxides, sodium hydroxides, and potassium hydroxides.

Exemplary ammonium hydroxides include ammonium hydroxides and quaternary ammonium hydroxides, and quaternary phosphonium hydroxides.

Exemplary alkali metal carbonates include lithium carbonates, sodium carbonates, and potassium carbonates.

Exemplary antiseptic/antifungal agents include sodium dehydroacetate, sodium sorbate, 2-pyridinethiol-1-oxide sodium, sodium benzoate, and pentachlorophenol sodium.

Exemplary chelating reagents include sodium ethylenediamine tetraacetate, sodium nitrilotriacetate, sodium hydroxyethyl ethylenediamine triacetate, sodium diethylenetriamine pentaacetate, and sodium uramil diacetate.

Exemplary antirust agents include acidic sulfite, sodium thiosulfate, ammonium thiodiglycolate, diisopropyl ammonium nitrite, pentaerythritol tetranitrate, and dicyclohexylammonium nitrite.

Exemplary antioxidants include phenol antioxidants (including hindered phenol antioxidants), amine antioxidants, sulfur antioxidants, and phosphorus antioxidants.

Exemplary ultraviolet ray absorbers include benzophenone ultraviolet ray absorbers, benzotriazole ultraviolet ray absorbers, salicylate ultraviolet ray absorbers, cyanoacrylate ultraviolet ray absorbers, and nickel complex salt ultraviolet ray absorbers.

<Preparation of Ink Jet Recording Ink>

Exemplary recording inks according to the present invention include at least a water soluble colorant, a water-soluble organic solvent, a surfactant, a penetrant, a water-dispersible resin, and water. Exemplary inks may also include other components, as necessary. The foregoing components are dispersed or dissolved in an aqueous solvent, and further stirred and mixed as necessary, to produce recording inks according to the present invention. Dispersing may be performed using a sand mill, a homogenizer, a ball mill, a paint shaker, or an ultrasonic dispersing machine, and stirring and mixing may be performed using a stirring machine using a typical stirring blade, a magnetic stirrer, or a high-speed dispersing machine.

<Physical Properties and Color of Ink Jet Recording Ink>

A viscosity of the recording ink at 25° C. is preferably 5 mPa·s to 20 mPa·s. When the viscosity is 5 mPa·s or more, the ink provide higher image density and better image quality. Excellent discharge ability is maintained by adjusting the ink viscosity to 20 mPa·s or less.

Viscosity of the recording ink can be measured at 25° C. using a viscometer (RE-550L, manufactured by Toki Sangyo Co.).

Static surface tension of the recording ink at 25° C. is preferably 20 mN/m to 35 mN/m, and more preferably 20 mN/m to 30 mN/m. When the static surface tension is 20 mN/m to 35 mN/m, increased permeability results in decrease of bleeding, so that excellent drying properties are obtained when printing on regular paper. The recording ink is easily wettable to a pretreated layer, which results in excellent color development and reduced formation of white spots. When the static surface tension is more than 35 mN/m, it is difficult to obtain ink leveling on the recording medium, resulting in extension of drying time.

An average particle diameter (D50) of the ink is preferably 10 nm to 300 nm, and more preferably 40 nm to 200 nm.

When average particle diameter is less than 10 nm, the viscosity of the ink is such that it is difficult to discharge the ink via an inkjet printhead.

Further, if average particle diameter is over 300 nm, particles may block the nozzle of a printer.

The color of the recording ink according to the present invention is not particularly limited and may be appropriately selected depending on the purpose. Examples of the colors include yellow, magenta, cyan, and black. When recording is performed using an ink set employing the combination of two or more colors, a multicolor image can be formed, and when recording is performed by using an ink set employing a full-color combination, a full-color image can be formed.

The recording ink of the present invention can be advantageously used in printers using the following inkjet heads: a piezo-type inkjet head in which a piezoelectric element is used as a pressure generating unit that pressurizes ink located in an ink channel to deform an oscillation plate forming a wall surface of the ink channel, and the internal volume of the ink channel is changed thereby discharging an ink droplet (see JP-A No. 02-51734), a thermal-type inkjet head that uses a heat-generating resistor to heat the ink in an ink channel and generate gas bubbles (see JP-A No. 61-59911), and an electrostatic inkjet head in which an oscillation plate forming a wall surface of an ink channel is disposed opposite to an electrode, and the oscillation plate is deformed by electrostatic forces generated between the oscillation plate and the electrode so as to change the internal volume of the ink channel, thereby discharging an ink droplet (see JP-A No. 06-71882).

The recording ink of the present invention may also be used in printers that facilitate printing fixation by heating a recording medium or a recording ink at 50° C. to 200° C. during, before or after the printing.

<Recording Medium>

Exemplary recording media include regular paper having no coat layer, and preferably regular paper having sizing degree of 10S or more, and air permeability of 5S to 50S, which is generally used as copy paper.

<Ink Jet Recording Method (Image Forming Method)>

Inkjet recording methods (image forming methods) according to the present invention include at least a treatment step in which a treatment liquid according to the present invention is coated onto a recording medium, and an ink discharging step in which an ink is applied, e.g., by impulse, to the treatment liquid coated recording medium to form an image.

In embodiments, a treatment liquid may be applied to a recording medium, e.g., by coating, after an image is formed on the recording medium by discharging ink onto such recording medium.

<Treatment Liquid Coating Processes>

Inkjet recording treatment liquids according to the present invention may be applied to a recording medium by any suitable technique by which a substantially uniform coating may be obtained.

Exemplary coating methods include blade coating, gravure coating, gravure offset coating, bar coating, roll coating, knife coating, air knife coating, comma coating, U-comma coating, AKKU coating, smoothing coating, micro gravure coating, reverse roll coating, 4-roll or 5-roll coating, dip coating, curtain coating, slide coating, and die-coating.

Treatment liquids may be coated on dry surfaces and or surfaces that are not completely dry.

In embodiments, a step of drying the treatment liquid coating may be carried out. In such a drying step, a recording medium coated with the treatment liquid may be dried by at least one of a roll heater, a drum heater, and warm air.

An amount of wetting adhesion of the treatment liquid to a recording medium may range from 0.1 g/m$^2$ to 30.0 g/m$^2$, and more preferably from 0.2 g/m$^2$ to 10.0 g/m$^2$.

When wetting adhesion is less than 0.1 g/m$^2$, improvement of image quality (image density, saturation, color bleed, character feathering, and white spot) is negligible. When wetting adhesion is more than 30.0 g/m$^2$, it is possible that the recording medium will not have a regular feel and/or curling of the recording medium may occur.

<Ink Discharge Step>

In embodiments, ink is discharged onto a treatment-liquid coated recording medium to form an image by impulse. In alternative embodiments, ink is discharged onto a recording medium to form an image by impulse prior to coating with a treatment liquid.

Any known inkjet recording method may be employed to form an image on a recording medium in the methods of the present invention. Exemplary methods include inkjet recording methods in which a printhead scans line by line to form an image on a recording medium.

Exemplary inkjet recording methods include methods employing an on-demand head using a piezoelectric actuator such as PZT; methods in which thermal energy is applied to an on-demand head; methods using an on-demand head using an actuator utilizing electrostatic force; and methods using a charge controlling type continuous injection head. When using the methods in which thermal energy is applied to a head, it is hard to freely control discharging of ink drops and the image quality varies depending on types of recording media. However, by applying the treatment liquid of the present invention on the media, such a problem can be avoided, and stable image quality can be obtained on various recording media.

<Inkjet Recording Apparatus>

Figure 2:
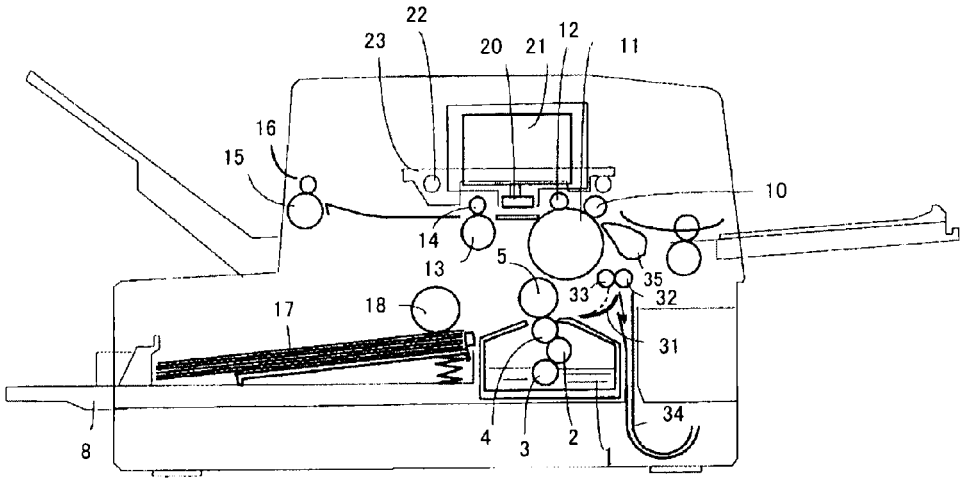
FIG. 2 is a cross-sectional side view of an exemplary apparatus according to the present invention.

Exemplary apparatus for applying the treatment liquid according to the present invention to a recording medium and for forming an image thereafter are shown in FIG. 1 and FIG. 2.

The inkjet recording apparatus shown in FIG. 1 is an inkjet printer including a scanning inkjet printhead. Treatment with the treatment liquid according to the present invention may be carried out in the inkjet recording apparatus shown in FIG. 1 as follows. A recording medium 6 is fed by a paper feed roller 7, and a treatment liquid 1 is uniformly and thinly applied on the recording medium 6 by an applicator roller 4 and a counter roller 5. The treatment liquid 1 is drawn by a drawing roller 3 and then uniformly applied to the applicator roller 4 while the thickness is controlled by a thickness controlling roller 2. The recording medium 6 is fed to a recording scanning section having an inkjet recording head 20 while being applied with the treatment liquid 1. The distance between a treatment end point (i.e., a point A in FIG. 1) and a starting point of record scanning (i.e., a point B in FIG. 1) is longer than the length of the recording medium 6 in the feeding direction. Therefore when the tip edge of the recording medium 6 reaches the starting point of record scanning B, the treatment operation has been completed. In this case, the treatment operation has been completed before the recording medium 6 is intermittently fed such that images are recorded thereon by scanning the inkjet recording head 20. Namely, the treatment liquid 1 can be applied continuously on the recording medium 6 at a constant speed. Therefore, the treatment liquid 1 can be uniformly applied on the recording medium 6. In the recording apparatus shown in FIG. 1, the recording medium 6 on which the treatment liquid 1 is to be applied is set in the lower cassette. A recording medium 17 on which the treatment liquid 1 need not or should not to be applied is set in the upper cassette. Therefore, it is advantageous to provide a distance between the cassette and the recording portion long enough to apply the treatment liquid 1.

The inkjet recording apparatus shown in FIG. 2 is a further inkjet printer including a scanning inkjet printhead. The recording apparatus shown in FIG. 2 is more compact than the recording apparatus shown in FIG. 1. A recording medium 17 is fed by a paper feed roller 18, and a treatment liquid 1 is uniformly and thinly applied on the recording medium 17 by an applicator roller 4 and a counter roller 5. The treatment liquid 1 is drawn by a drawing roller 3 and is uniformly applied to the applicator roller 4 by a thickness controlling roller 2. The recording medium 17 is fed while being applied with the treatment liquid 1 and passes through a recording scanning portion having an inkjet recording head 20. The recording medium 17 is fed until the recording medium 17 is completely subjected to the treatment. When the treatment is completed, the recording medium 17 is returned such that the leading edge of the recording medium 17 is located at the starting position of record scanning. The completion of the treatment operation can be determined, for example, by detecting the recording medium 17 using a known detector (not shown) provided at the exit of the treatment liquid application device. This detector is not necessary to be provided. Alternatively, information about the length of the recording medium 17 is preliminarily input to a controller and the rotation number of the motor which drives the feeding rollers is controlled such that the feed par revolution of the circumference of the feeding roller for the recording medium 17 corresponds to the length of the recording medium 17.

In FIGS. 1 and 2, 8 denotes a paper feed tray, 10 denotes a paper feed roller, 11 to 16 denote recording medium feed rollers, 18 denotes a paper feed roller, 21 denotes an ink cartridge, 22 denotes a carriage axis, 23 denotes a carriage, 32 and 33 denote recording medium feed rollers, and 35 denotes a paper feed guide.

The recording medium 17 on which the treatment liquid 1 has been applied, is again fed to the recording scanning position before the treatment liquid is dried and solidified, wherein the recording medium 17 is intermittently fed in synchronization with scanning by means of an inkjet recording head 20. If the recording medium 17 is returned through the same passage through which the recording medium 17 has been fed, the rear edge of the recording medium 17 goes into the treatment liquid application device and thereby problems such that the recording medium 17 is contaminated by the treatment liquid, unevenly applied with the treatment liquid 1 or jammed at the device occur. Therefore, when the recording medium 17, on which the treatment liquid 1 has been applied, is returned, the passage of the recording medium 17 is changed by a guide 31. Namely, the position of the guide 31 is changed to the position illustrated by a dotted line using a known means such as a solenoid or a motor, such that the recording medium 17 is returned through a guide for return 34. Thus the problems mentioned above can be avoided.

The treatment liquid application step is preferably performed continuously at a constant linear velocity of 10 mm/s to 1,000 mm/s.

Even in a case such that this time difference is fairly large, since the treatment liquid of the present invention includes a large amount of a hydrophilic solvent having a higher boiling point than water and a low evaporating speed and in addition the water content of the treatment liquid is controlled so as to be almost equal to the equilibrium water content of the air in the environment where the printer is used, the evaporation of water in the treatment liquid can be fairly prevented.

Therefore, the difference in image qualities between the tip edge of a recording sheet and the rear edge thereof is so little as not to be visually detected.

As can be understood from the above description, the recording medium on which the treatment liquid has been applied is often necessary to be fed by means of contact-feeding elements such as a roller, a guide, etc. for image formation. In this case, when the treatment liquid applied on the recording medium is transferred onto the feeding members, a feeding failure occurs or a problem occurs in that the image quality is lowered due to contamination of the feeding members. In order to avoid such problems, from the standpoint of the apparatus, it is preferable to use a waved guide plate and a guide roller with a spur. In addition, it is also preferable that the surface of a roller is formed of a water repellant material.

However, it is important that the treatment liquid applied on the recording medium is rapidly absorbed therein such that the surface of the recording medium is dried in appearance. In order that the recording medium applied with a treatment liquid achieves such a state, the treatment liquid preferably has a surface tension of 40 mN/m or less so as to immediately penetrate into the recording medium. The passage "the treatment liquid is dried and solidified" after the treatment liquid has been applied on the recording medium means that the treatment liquid applied is solidified after the liquid components therein have evaporated and cannot be maintained in the liquid state, but does not mean that the treatment liquid applied on a recording medium appears to be dried in appearance because of being absorbed in the recording medium. By using such recording apparatus as mentioned above which include a combination of a treatment liquid application device and an image recording device, the inkjet recording can be performed on a recording medium in which the treatment liquid is penetrated and the surface of the recording medium is dried in appearance, but the treatment liquid is not solidified. Therefore, even when the treatment liquid is applied in a relatively small amount, the image quality can be outstandingly improved.

In order to control the operation of the image recording apparatuses as shown in FIGS. 1 and 2, when a print order is received by a host machine such as a personal computer, the image recording apparatus (including the treatment applicator) starts to perform preliminary operations (i.e., a treatment liquid application step and a head cleaning step at the same time). After completion of the preliminary operations, the image recording apparatus starts to perform an image recording operation. At the data transmitting operation, the image data transmitted per one time may be the data corresponding to one scanning line images, plural scanning line images, or one page images. The head cleaning operation and ink-discharging check operation are not necessarily performed. In addition, it is not necessary to sequentially perform the head cleaning and ink-discharging check operations, and the image data processing and image data transmission operations. Namely, it is possible to perform in parallel the treatment, head cleaning, ink-discharging check, image data processing and image data transmission operations. By performing these operations in parallel, images can be recorded without substantially deteriorating throughput of the image recording apparatus even when the treatment liquid application step is performed.

The ink of the present invention or treatment liquid can be accommodated in a cartridge container, and the ink cartridge may be further equipped with suitably selected other members.

The container is suitably selected depending on the intended purpose without any restriction in the shape, structure, size, and material thereof. Suitable examples of the container include those having an ink bag formed of an aluminum laminate film or resin film.

An embodiment of the ink cartridge for the ink or treatment liquid will be explained hereinafter with reference to FIG. 3 and FIG. 4.

Figure 3:
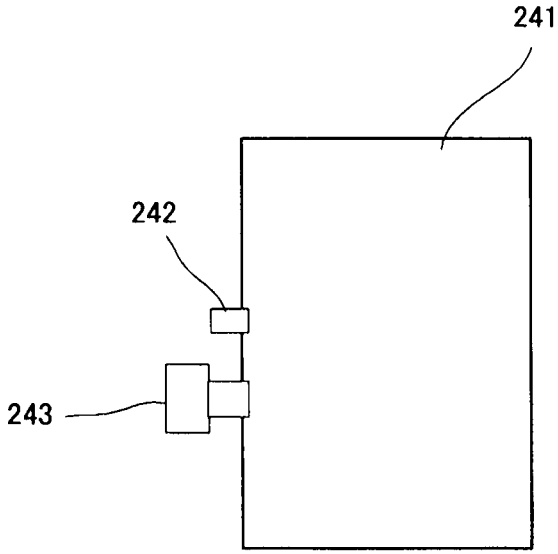
FIG. 3 is a schematic view of an exemplary treatment liquid cartridge according to the present invention.
Figure 4:
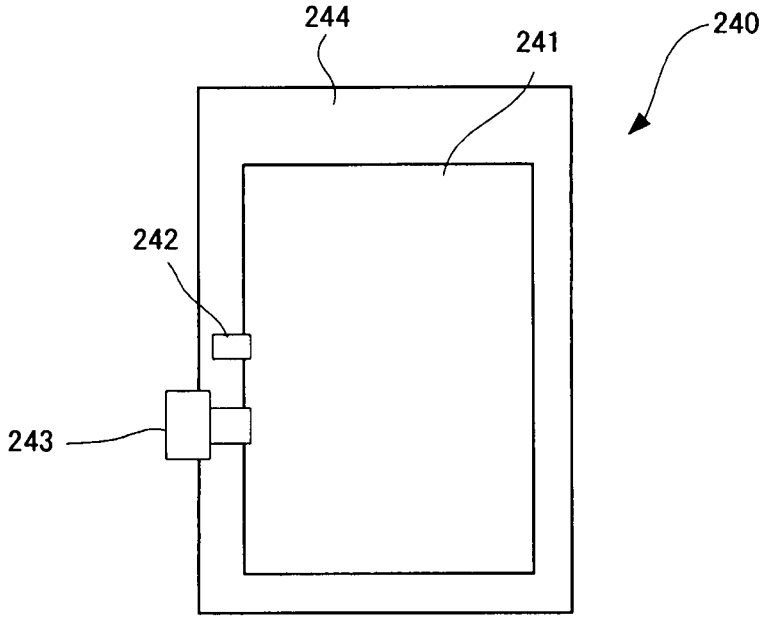
FIG. 4 is a schematic view of an exemplary ink cartridge according to the present invention.

FIG. 3 is a schematic diagram showing a treatment liquid-storing bag 241, and FIG. 4 is a schematic diagram showing a cartridge 240 in which a treatment liquid-storing bag 241 is accommodated in a cartridge case 244. A treatment liquid is introduced into the treatment liquid-storing bag 241 from an inlet 242, followed by releasing the air remained in the treatment liquid-storing bag 241, and then the treatment liquid-storing bag 241 is sealed by closing the inlet 242 with heat. When the cartridge 240 is used, the cartridge 240 is set in an recording device by inserting a needle equipped in the body of the device into an outlet 243 formed of a rubber member to supply the treatment liquid to the device. The treatment liquid-storing bag 241 is formed of a wrapping member such as an aluminum laminate film. This treatment liquid-storing bag 241 is accommodated in the cartridge case 244, generally formed of a plastic, and as the cartridge 240, it is detachably mounted to various inkjet recording devices.

Hereinafter, Examples of the present invention will be described, which however shall not be construed as limiting the scope of the present invention. All part(s) are by mass unless indicated otherwise.

EXAMPLES

In the following examples, and throughout this specification, all parts and percentages are by weight, and all temperatures are in degrees Celsius, unless expressly stated to be otherwise. Where the solids content of a dispersion or solution is reported, it expresses the weight of solids based on the total weight of the dispersion or solution, respectively. Where a molecular weight is specified, it is the molecular weight range ascribed to the product by the commercial supplier, which is identified. Generally this is believed to be weight average molecular weight.

Preparation Example 1

Preparation of Magenta Pigment-Containing Fine Polymer Particle Dispersion Liquid <Preparation of Polymer Solution A>

A 1 L flask equipped with a mechanical stirrer, a thermometer, a nitrogen gas introducing tube, a reflux tube, and a dropping funnel was purged with nitrogen gas, and then 11.2 g of styrene, 2.8 g of acrylic acid, 12.0 g of lauryl methacrylate, 4.0 g of polyethylene glycol methacrylate, 4.0 g of styrene macromer, and 0.4 g of mercaptoethanol were mixed therein, and a temperature of the mixture was raised to 65° C.

Subsequently, a mixed solution of 100.8 g of styrene, 25.2 g of acrylic acid, 108.0 g of lauryl methacrylate, 36.0 g of polyethylene glycol methacrylate, 60.0 g of hydroxyethyl methacrylate, 36.0 g of styrene macromer, 3.6 g of mercaptoethanol, 2.4 g of azobismethyl valeronitrile, and 18 g of methyl ethyl ketone was added dropwise to the flask over 2.5 hours. Subsequently, a mixed solution of 0.8 g of azobismethyl valeronitrile and 18 g of methyl ethyl ketone was added dropwise to the flask over 0.5 hours. After allowing the mixture to stand at 65° C. for one hour, 0.8 g of azobismethyl valeronitrile was added, and the mixture was allowed to stand for a further hour. After the termination of the reaction, 364 g of methyl ethyl ketone was added to the flask to prepare 800 g of Polymer Solution A having a concentration of 50% by mass.

<Preparation of Pigment-Containing Fine Polymer Particle Dispersion Liquid>

28 g of Polymer Solution A, 42 g of C.I. Pigment Red 122, 13.6 g of 1 mol/L aqueous potassium hydroxide solution, 20 g of methyl ethyl ketone, and 13.6 g of ion-exchanged water were thoroughly stirred, and kneaded using a roll mill. The obtained paste was charged in 200 g of pure water, and stirred. Thereafter, the mixture was treated with an evaporator so as to evaporate methyl ethyl ketone and water, and then the dispersion liquid was filtered under pressure through a polyvinylidene fluoride membrane filter having an average pore diameter of 5.0 μm so as to remove coarse particles, thereby obtaining magenta pigment-containing fine polymer particle dispersion liquid which contained 15% by mass of the pigment and had a solid content of 20% by mass. The average particle diameter (D50) was measured by a particle size distribution measurement device (NANOTRACK UPA-EX150, manufactured by Nikkiso Co. Ltd.). The fine polymer particles had an average particle diameter (D50) of 82.7 nm in the obtained magenta pigment-containing fine polymer particle dispersion liquid.

Preparation Example 2

Preparation of Cyan Pigment-Containing Fine Polymer Particle Dispersion Liquid A cyan pigment-containing fine polymer particle dispersion liquid was prepared in the same manner as in Preparation Example 1, except that as a pigment C.I. Pigment Red 122 in Preparation Example 1 was replaced with phthalocyanine pigment (C.I. Pigment Blue 15:3).

The average particle diameter (D50) was measured by a particle size distribution measurement device (NANOTRACK UPA-EX150, manufactured by Nikkiso Co. Ltd.). The fine polymer particles had an average particle diameter (D50) of 110.6 nm in the obtained cyan pigment-containing fine polymer particle dispersion liquid.

Preparation Example 3

Preparation of Yellow Pigment-Containing Fine Polymer Particle Dispersion Liquid A yellow pigment-containing fine polymer particle dispersion liquid was prepared in the same manner as in Preparation Example 1, except that as a pigment C.I. Pigment Red 122 in Preparation Example 1 was replaced with monoazo yellow pigment (C.I. Pigment Yellow 74).

The average particle diameter (D50) was measured by a particle size distribution measurement device (NANOTRACK UPA-EX150, manufactured by Nikkiso Co. Ltd.). The fine polymer particles had an average particle diameter (D50) of 105.4 nm in the obtained yellow pigment-containing fine polymer particle dispersion liquid.

Preparation Example 4

Preparation of Carbon Black Pigment-Containing Fine Polymer Particle Dispersion Liquid A carbon black pigment-containing fine polymer particle dispersion liquid was prepared in the same manner as in Preparation Example 1, except that as a pigment C.I. Pigment Red 122 in Preparation Example 1 was replaced with carbon black (FW100, manufactured by Degussa).

The average particle diameter (D50) was measured by a particle size distribution measurement device (NANOTRACK UPA-EX150, manufactured by Nikkiso Co. Ltd.). The fine polymer particles had an average particle diameter (D50) of 75.2 nm in the obtained carbon black pigment-containing fine polymer particle dispersion liquid.

Preparation Examples 5 to 20

Preparation of Recording Inks

Materials, shown below, were combined and stirred. The resulting dispersion liquids were subjected to pressure filtration using a polyvinylidene fluoride membrane filter having an average pore size of 5.0 μm, so as to remove coarse particles and contaminants, thereby preparing each of recording inks.

| Preparation of Ink 1 (Black Ink 1) | |
|---|---|
| black pigment dispersion liquid of Preparation Example 4 (as solid content) | 7% |
| diethylene glycol | 5% |
| glycerin | 10% |
| 2-pyrrolidone | 2% |
| FS-300 (fluorine surfactant manufactured by DuPont) | 1% |
| 2,2,4-trimethyl-1,3-pentanediol | 2% |
| ion-exchange water | 73% |

| Preparation of Ink 2 (Yellow Ink 1) | |
|---|---|
| yellow pigment dispersion liquid (as solid content) made by the Preparation Example 3 | 4.5% |
| 1,3-butanediol | 10% |
| glycerin | 8% |
| 2-pyrrolidone | 2% |
| S-111 (fluorine surfactant manufactured by Asahi Glass Company) | 1% |
| 2,2,4-trimethyl-1,3-pentanediol | 2% |
| ion-exchange water | 72.5% |

| Preparation of Ink 3 (Magenta Ink 1) | |
|---|---|
| magenta pigment dispersion liquid of Preparation Example 1 (as solid content) | 7% |
| triethyleneglycol isobutylether | 2% |
| glycerin | 15% |
| fluorine surfactant of the compound of formula (I) ($R_1$, $R_3$: H, $R_2$, $R_4$: $CF_3$, p, r: 4, q: 1, m: 21, n: 0) | 2% |
| 2-ethyl-1,3-hexanediol | 2% |
| ion-exchange water | 72% |

| Preparation of Ink 4 (Cyan Ink 1) | |
|---|---|
| cyan pigment dispersion liquid of Preparation Example 2 (as solid content) | 4.5% |
| 3-methyl-1,3-butanediol | 8% |
| glycerin | 8% |
| FC430 (fluorine surfactant manufactured by SUMITOMO 3M) | 2% |
| 2-ethyl-1,3-hexanediol | 2% |
| ion-exchange water | 75.5% |

| Preparation of Ink 5 (Black Ink 2) | |
|---|---|
| black pigment dispersion liquid (as solid content) made by the Preparation Example 4 | 8% |
| 1,2-hexanediol | 5% |
| glycerin | 20% |
| 2-pyrrolidone | 2% |
| FSN-100 (fluorine surfactant manufactured by DuPont) | 0.5% |
| ion-exchange water | 64.5% |

| Preparation of Ink 6 (Yellow Ink 2) | |
|---|---|
| yellow pigment dispersion liquid of Preparation Example 3 (as solid content) | 4.5% |
| 1,5-pentaneiol | 10% |
| glycerin | 20% |
| 2-pyrrolidone | 2% |
| S-131 (fluorine surfactant manufactured by Asahi Glass Company) | 0.75% |
| 2,2,4-trimethyl-1,3,-pentanediol | 2% |
| ion-exchange water | 60.75% |

| Preparation of Ink 7 (Magenta Ink 2) | |
|---|---|
| magenta pigment dispersion liquid of Preparation Example 1 (as solid content) | 7% |
| ethyleneglycol monobutylether | 2% |
| glycerin | 16% |
| fluorine surfactant of the compound of formula (II) ($R_1$, $R_2$, $R_3$: $C_2F_5$, M: Na) | 0.2% |
| EP-7025 (nonionic surfactant manufactured by Nippon Shokubai Co., Ltd.) | 1% |
| 2-ethyl-1,3-hexanediol | 2% |
| ion-exchange water | 71.8% |

| Preparation of Ink 8 (Cyan Ink 2) | |
|---|---|
| cyan pigment dispersion liquid of Preparation Example 2 (as solid content) | 5% |
| 1,5-pentanediol | 8% |
| glycerin | 20% |
| FC470 (fluorine surfactant manufactured by DIC corporation) | 2% |
| ion-exchange water | 65% |

| Preparation of Ink 9 (Black Ink 3) | |
|---|---|
| self dispersing pigment dispersion CAB-O-JET 300 (as solid content) | 7.5% |
| diethyleneglycol | 4% |
| glycerin | 24% |
| 2-pyrrolidone | 2% |
| S-145 (fluorine surfactant manufactured by Asahi Glass Company) | 1% |
| 2,2,4-trimethyl-1,3,-pentanediol | 2% |
| water dispersion resin FE4500 (manufactured by Asahi Glass Company) | 5% |
| ion-exchange water | 54.5% |

| Preparation of Ink 10 (Yellow Ink 3) | |
|---|---|
| self dispersing pigment dispersion CAB-O-JET 270 (as solid content) | 4.5% |
| 1,3-butanediol | 10% |
| glycerin | 22% |
| 2-pyrrolidone | 2% |
| FS-300(fluorine surfactant: manufactured by DuPont) | 1.5% |
| 2,2,4-trimethyl-1,3,-pentanediol | 2% |
| ion-exchange water | 58% |

| Preparation of Ink 11 (Magenta Ink 3) | |
|---|---|
| self dispersing pigment dispersion CAB-O-260 (as solid content) | 7% |
| triethyleneglycol isobutylether | 4% |
| glycerin | 25% |
| fluorine surfactant of compound of formula (I) ($R_1$, $R_3$: H, $R_2$, $R_4$: $CF_3$, p, r: 4, q: 1, m: 21, n: 0) | 2% |
| 2-ethyl-1,3-hexanediol | 2% |
| water dispersion resin FEM-500 (Manufactured by DIC corporation) | 4% |
| Ion-exchange water | 56% |

| Preparation of Ink 12 (Cyan Ink 3) | |
|---|---|
| self dispersing pigment dispersion CAB-O-JET 250 (manufactured by Cabot Corporation) (as solid content) | 5% |
| 3-methyl-1,3-butanediol | 10% |
| glycerin | 24% |
| FC430 (fluorine surfactant manufactured by SUMITOMO 3M) | 2% |
| 2-ethyl-1,3-hexanediol | 2% |
| ion-exchange water | 57% |

—Preparation of Treatment Liquids—

Materials, shown below, were combined and stirred. The resulting dispersion liquid was subjected to pressure filtration using a polyvinylidene fluoride membrane filter having an average pore size of 5.0 μm, so as to remove coarse particles and contaminants, thereby preparing each of treatment liquids.

| Preparation of Treatment Liquid 1 | |
|---|---|
| diethyleneglycol | 10% |
| glycerin | 10% |
| 2-ethyl-1,3-hexanediol | 2% |
| fluorine surfactant of compound of formula (I) ($R_1$, $R_3$: H, $R_2$, $R_4$: $CF_3$, p, r: 4, q: 1, m: 21, n: 0) | 2% |
| fluorine surfactant of compound of formula (II) ($R_5$, $R_6$, $R_7$: $C_2F_5$, M: Na) | 10% |
| ion-exchange water | 66% |

| Preparation of Treatment Liquid 2 | |
|---|---|
| 1,3-butanediol | 20% |
| glycerin | 10% |
| 2-ethyl-1,3-hexanediol | 2% |
| fluorine surfactant of compound of formula (I) ($R_1$, $R_3$: H, $R_2$, $R_4$: $C_2F_5$, p, r: 4, q: 1, m: 21, n: 0) | 2% |
| fluorine surfactant of compound of formula (II) ($R_5$, $R_6$, $R_7$: $C_2F_5$, M: Na) | 20% |
| ion-exchange water | 46% |

| Preparation of Treatment Liquid 3 | |
|---|---|
| 1,3-butanediol | 10% |
| glycerin | 10% |
| 2-ethyl-1,3-hexanediol | 2% |
| fluorine surfactant of compound of formula (I) ($R_1$, $R_3$: H, $R_2$, $R_4$: $CF_3$, p, r: 4, q: 1, m: 21, n: 0) | 2% |
| fluorine surfactant of compound of formula (II) ($R_5$, $R_6$, $R_7$: $C_2F_5$, M: Li) | 30% |
| ion-exchange water | 46% |

| Preparation of Treatment Liquid 4 | |
|---|---|
| 3-ethyl-1,3-butanediol | 20% |
| glycerin | 10% |
| 2-ethyl-1,3-hexanediol | 2% |
| fluorine surfactant of compound of formula (I) ($R_1$, $R_3$: H, $R_2$, $R_4$: $C_2F_5$, p, r: 4, q: 1, m: 21, n: 0) | 2% |
| fluorine surfactant of compound of formula (II) ($R_5$, $R_6$, $R_7$: $C_2F_5$, M: Na) | 20% |
| ion-exchange water | 46% |

| Preparation of Treatment Liquid 5 | |
|---|---|
| triethyleneglycolisobuthylether | 5% |
| glycerin | 15% |
| 2-ethyl-1,3-hexanediol | 2% |
| fluorine surfactant of compound of formula (I) ($R_1$, $R_3$: $OCH_3$, $R_2$, $R_4$: $CH_3$, p, r: 4, q: 1, m: 21, n: 0) | 4% |
| fluorine surfactant of compound of formula (II) ($R_5$, $R_6$, $R_7$: $C_2F_5$, M: Na) | 10% |
| ion-exchange water | 64% |

| Preparation of Treatment Liquid 6 | |
|---|---|
| 1,3-butanediol | 20% |
| glycerin | 10% |
| 2-ethyl-1,3-hexanediol | 2% |
| fluorine surfactant of compound of formula (I) ($R_1$, $R_3$: $OC_2H_5$, $R_2$, $R_4$: $C_2F_5$, p, r: 4, q: 1, m: 21, n: 0) | 0.02% |
| fluorine surfactant of compound of formula (II) ($R_5$, $R_6$, $R_7$: $C_2F_5$, M: Na) | 40% |
| ion-exchange water | 27.98% |

| Preparation of Treatment Liquid 7 | |
|---|---|
| diethyleneglycol | 10% |
| glycerin | 10% |
| 2-ethyl-1,3-hexanediol | 2% |
| fluorine surfactant of compound of formula (I) ($R_1$, $R_3$: $OCH_3$, $R_2$, $R_4$: $CH_3$, p, r: 4, q: 1, m: 21, n: 0) | 2% |
| surfactant of compound of formula (II) ($R_5$, $R_6$, $R_7$: $C_2F_5$, M: Na) | 10% |
| ion-exchange water | 66% |

| Preparation of Treatment Liquid 8 | |
|---|---|
| 1,3-butanediol | 20% |
| glycerin | 10% |
| 2-ethyl-1,3-hexanediol | 2% |
| fluorine surfactant of compound of formula (I) ($R_1$, $R_3$: $OCH_3$, $R_2$, $R_4$: $C_2F_5$, p, r: 4, q: 1, m: 21, n: 0) | 2% |
| fluorine surfactant of compound of formula (II) ($R_5$, $R_6$, $R_7$: $C_2F_5$, M: Na) | 20% |
| ion-exchange water | 46% |

| Preparation of Treatment Liquid 9 | |
|---|---|
| diethyleneglycol | 10% |
| glycerin | 10% |
| 2-ethyl-1,3-hexanediol | 2% |
| fluorine surfactant of compound of formula (I) ($R_1$, $R_3$: H, $R_2$, $R_4$: $CH_3$, p, r: 4, q: 1, m: 21, n: 0) | 2% |
| fluorine surfactant of compound of formula (II) ($R_5$, $R_6$, $R_7$: $CF_3$, M: Na) | 10% |
| ion-exchange water | 66% |

| Preparation of Treatment Liquid 10 | |
|---|---|
| 1,3-butanediol | 20% |
| glycerin | 10% |
| 2-ethyl-1,3-hexanediol | 2% |
| fluorine surfactant of compound of formula (I) ($R_1$, $R_3$: H, $R_2$, $R_4$: $C_2F_5$, p, r: 4, q: 1, m: 21, n: 0) | 2% |
| fluorine surfactant of compound of formula (II) ($R_5$, $R_6$, $R_7$: $OCF_3$, M: Na) | 20% |
| Ion-exchange water | 46% |

| Preparation of Treatment Liquid 11 | |
|---|---|
| diethyleneglycol | 10% |
| glycerin | 10% |

-continued

| Preparation of Treatment Liquid 11 | |
|---|---|
| 2-ethyl-1,3-hexanediol | 2% |
| fluorine surfactant of compound of formula (I) ($R_1$, $R_3$: H, $R_2$, $R_4$: $CH_3$, p, r: 4, q: 1, m: 21, n: 0) | 2% |
| fluorine surfactant of compound of formula (II) ($R_5$, $R_6$, $R_7$: F, M: Na) | 10% |
| ion-exchange water | 66% |

| Preparation of Treatment Liquid 12 | |
|---|---|
| 1,3-butanediol | 20% |
| glycerin | 10% |
| 2-ethyl-1,3-hexanediol | 2% |
| fluorine surfactant of compound of formula (I) ($R_1$, $R_3$: H, $R_2$, $R_4$: $C_2F_5$, p, r: 4, q: 1, m: 21, n: 0) | 2% |
| fluorine surfactant of compound of formula (II) ($R_5$, $R_6$, $R_7$: F, M: Na) | 20% |
| ion-exchange water | 46% |

| Preparation of Treatment Liquid 13 | |
|---|---|
| 1,3-butanediol | 10% |
| glycerin | 10% |
| 2-ethyl-1,3-hexanediol | 4% |
| fluorine surfactant of compound of formula (I) ($R_1$, $R_3$: $OCH_3$, $R_2$, $R_4$: $CF_3$, p, r: 4, q: 1, m: 21, n: 0) | 0.01% |
| ion-exchange water | 75.99% |

| Preparation of Treatment Liquid 14 | |
|---|---|
| 3-methyl-1,3-butanediol | 20% |
| glycerin | 10% |
| 2-ethyl-1,3-hexanediol | 2% |
| fluorine surfactant of compound of formula (I) ($R_1$, $R_3$: $OC_2H_5$, $R_2$, $R_4$: $C_2F_5$, p, r: 4, q: 1, m: 21, n: 0) | 5% |
| ion-exchange water | 63% |

| Preparation of Treatment Liquid 15 | |
|---|---|
| diethyleneglycol | 3% |
| glycerin | 20% |
| 2-ethyl-1,3-hexanediol | 2% |
| fluorine surfactant of compound of formula (I) ($R_1$, $R_3$: H, $R_2$, $R_4$: $C_2F_5$, p, r: 4, q: 1, m: 21, n: 0) | 0.5% |
| Ion-exchange water | 74.5% |

| Preparation of Treatment Liquid 16 | |
|---|---|
| 1,2-hexanediol | 10% |
| glycerin | 20% |
| 2-ethyl-1,3-hexanediol | 2% |
| fluorine surfactant of compound of formula (II) ($R_5$, $R_6$, $R_7$: $C_2F_5$, M: Na) | 40% |
| Ion-exchange water | 28% |

| Preparation of Treatment Liquid 17 | |
|---|---|
| 3-methyl-1,3-butanediol | 20% |
| glycerin | 10% |
| 2-ethyl-1,3-hexanediol | 2% |
| fluorine surfactant of compound of formula (II) ($R_5$, $R_6$, $R_7$: $C_2F_5$, M: Na) | 50% |
| ion-exchange water | 18% |

| Preparation of Treatment Liquid 18 | |
|---|---|
| glycerin | 10% |
| 3-methyl-1,3-butanediol | 10% |

-continued

| Preparation of Treatment Liquid 18 | |
|---|---|
| 2-ethyl-1,3-hexanediol | 2% |
| fluorine surfactant of compound of formula (II) ($R_5$, $R_6$, $R_7$: $CF_3$, M: Li) | 4% |
| ion-exchange water | 74% |

Examples 1 to 39 and Comparative Examples 1 to 18

Ink sets were prepared using Inks 1 to 12 and used with Treatment Liquids 1 to 18 as shown in TABLE 1 and TABLE 1 below.

TABLE 1

| | Ink set | | | | Treatment | Coating | Ink Deposit Amount |
|---|---|---|---|---|---|---|---|
| | Black | Cyan | Magenta | Yellow | Liquid | Method | ($g/m^2$) |
| Example 1 | Ink 1 | Ink 4 | Ink 3 | Ink 2 | Treatment Liquid 1 | Bar coating | 0.5 |
| Example 2 | Ink 5 | Ink 8 | Ink 7 | Ink 6 | Treatment Liquid 1 | Bar coating | 0.5 |
| Example 3 | Ink 9 | Ink 12 | Ink 11 | Ink 10 | Treatment Liquid 1 | Bar coating | 0.5 |
| Example 4 | Ink 1 | Ink 4 | Ink 3 | Ink 2 | Treatment Liquid 2 | Roll coating | 1.6 |
| Example 5 | Ink 5 | Ink 8 | Ink 7 | Ink 6 | Treatment Liquid 2 | Roll coating | 1.6 |
| Example 6 | Ink 9 | Ink 12 | Ink 11 | Ink 10 | Treatment Liquid 2 | Roll coating | 1.6 |
| Example 7 | Ink 1 | Ink 4 | Ink 3 | Ink 2 | Treatment Liquid 3 | Bar coating | 6.4 |
| Example 8 | Ink 5 | Ink 8 | Ink 7 | Ink 6 | Treatment Liquid 3 | Bar coating | 6.4 |
| Example 9 | Ink 9 | Ink 12 | Ink 11 | Ink 10 | Treatment Liquid 3 | Bar coating | 6.4 |
| Example 10 | Ink 1 | Ink 4 | Ink 3 | Ink 2 | Treatment Liquid 4 | Roll coating | 9 |
| Example 11 | Ink 5 | Ink 8 | Ink 7 | Ink 6 | Treatment Liquid 4 | Roll coating | 9 |
| Example 12 | Ink 9 | Ink 12 | Ink 11 | Ink 10 | Treatment Liquid 4 | Roll coating | 9 |
| Example 13 | Ink 1 | Ink 4 | Ink 3 | Ink 2 | Treatment Liquid 5 | Bar coating | 6.4 |
| Example 14 | Ink 5 | Ink 8 | Ink 7 | Ink 6 | Treatment Liquid 5 | Bar coating | 6.4 |
| Example 15 | Ink 9 | Ink 12 | Ink 11 | Ink 10 | Treatment Liquid 5 | Bar coating | 6.4 |
| Example 16 | Ink 1 | Ink 4 | Ink 3 | Ink 2 | Treatment Liquid 6 | Roll coating | 3 |
| Example 17 | Ink 5 | Ink 8 | Ink 7 | Ink 6 | Treatment Liquid 6 | Roll coating | 3 |
| Example 18 | Ink 9 | Ink 12 | Ink 11 | Ink 10 | Treatment Liquid 6 | Roll coating | 3 |
| Example 19 | Ink 1 | Ink 4 | Ink 3 | Ink 2 | Treatment Liquid 6 | Bar coating | 0.1 |
| Example 20 | Ink 5 | Ink 8 | Ink 7 | Ink 6 | Treatment Liquid 6 | Bar coating | 0.1 |
| Example 21 | Ink 9 | Ink 12 | Ink 11 | Ink 10 | Treatment Liquid 6 | Bar coating | 0.1 |
| Example 22 | Ink 1 | Ink 4 | Ink 3 | Ink 2 | Treatment Liquid 7 | Roll coating | 0.5 |
| Example 23 | Ink 5 | Ink 8 | Ink 7 | Ink 6 | Treatment Liquid 7 | Roll coating | 0.5 |
| Example 24 | Ink 9 | Ink 12 | Ink 11 | Ink 10 | Treatment Liquid 7 | Roll coating | 0.5 |
| Example 25 | Ink 1 | Ink 4 | Ink 3 | Ink 2 | Treatment Liquid 8 | Bar coating | 0.5 |
| Example 26 | Ink 5 | Ink 8 | Ink 7 | Ink 6 | Treatment Liquid 8 | Bar coating | 0.5 |
| Example 27 | Ink 9 | Ink 12 | Ink 11 | Ink 10 | Treatment Liquid 8 | Bar coating | 0.5 |

TABLE 1-continued

| | Ink set | | | | Treatment | Coating | Ink Deposit Amount |
|---|---|---|---|---|---|---|---|
| | Black | Cyan | Magenta | Yellow | Liquid | Method | (g/m$^2$) |
| Example 28 | Ink 1 | Ink 4 | Ink 3 | Ink 2 | Treatment Liquid 9 | Roll coating | 0.5 |
| Example 29 | Ink 5 | Ink 8 | Ink 7 | Ink 6 | Treatment Liquid 9 | Roll coating | 0.5 |
| Example 30 | Ink 9 | Ink 12 | Ink 11 | Ink 10 | Treatment Liquid 9 | Roll coating | 0.5 |
| Example 31 | Ink 1 | Ink 4 | Ink 3 | Ink 2 | Treatment Liquid 10 | Bar coating | 0.5 |
| Example 32 | Ink 5 | Ink 8 | Ink 7 | Ink 6 | Treatment Liquid 10 | Bar coating | 0.5 |
| Example 33 | Ink 9 | Ink 12 | Ink 11 | Ink 10 | Treatment Liquid 10 | Bar coating | 0.5 |
| Example 34 | Ink 1 | Ink 4 | Ink 3 | Ink 2 | Treatment Liquid 11 | Roll coating | 0.5 |
| Example 35 | Ink 5 | Ink 8 | Ink 7 | Ink 6 | Treatment Liquid 11 | Roll coating | 0.5 |
| Example 36 | Ink 9 | Ink 12 | Ink 11 | Ink 10 | Treatment Liquid 11 | Roll coating | 0.5 |
| Example 37 | Ink 1 | Ink 4 | Ink 3 | Ink 2 | Treatment Liquid 12 | Bar coating | 0.5 |
| Example 38 | Ink 5 | Ink 8 | Ink 7 | Ink 6 | Treatment Liquid 12 | Bar coating | 0.5 |
| Example 39 | Ink 9 | Ink 12 | Ink 11 | Ink 10 | Treatment Liquid 12 | Bar coating | 0.5 |

TABLE 2

| | Ink set | | | | Treatment | Coating | Ink Deposit Amount |
|---|---|---|---|---|---|---|---|
| | Black | Cyan | Magenta | Yellow | Liquid | Method | (g/m$^2$) |
| Comparative Example 1 | Ink 1 | Ink 4 | Ink 3 | Ink 2 | Treatment Liquid 13 | Bar coating | 0.5 |
| Comparative Example 2 | Ink 5 | Ink 8 | Ink 7 | Ink 6 | Treatment Liquid 13 | Bar coating | 0.5 |
| Comparative Example 3 | Ink 9 | Ink 12 | Ink 11 | Ink 10 | Treatment Liquid 13 | Bar coating | 0.5 |
| Comparative Example 4 | Ink 1 | Ink 4 | Ink 3 | Ink 2 | Treatment Liquid 14 | Roll coating | 1.6 |
| Comparative Example 5 | Ink 5 | Ink 8 | Ink 7 | Ink 6 | Treatment Liquid 14 | Roll coating | 1.6 |
| Comparative Example 6 | Ink 9 | Ink 12 | Ink 11 | Ink 10 | Treatment Liquid 14 | Roll coating | 1.6 |
| Comparative Example 7 | Ink 1 | Ink 4 | Ink 3 | Ink 2 | Treatment Liquid 15 | Bar coating | 6.4 |
| Comparative Example 8 | Ink 5 | Ink 8 | Ink 7 | Ink 6 | Treatment Liquid 15 | Bar coating | 6.4 |
| Comparative Example 9 | Ink 9 | Ink 12 | Ink 11 | Ink 10 | Treatment Liquid 15 | Bar coating | 6.4 |
| Comparative Example 10 | Ink 1 | Ink 4 | Ink 3 | Ink 2 | Treatment Liquid 16 | Roll coating | 0.1 |
| Comparative Example 11 | Ink 5 | Ink 8 | Ink 7 | Ink 6 | Treatment Liquid 16 | Roll coating | 0.1 |
| Comparative Example 12 | Ink 9 | Ink 12 | Ink 11 | Ink 10 | Treatment Liquid 16 | Roll coating | 0.1 |
| Comparative Example 13 | Ink 1 | Ink 4 | Ink 3 | Ink 2 | Treatment Liquid 17 | Bar coating | 0.05 |
| Comparative Example 14 | Ink 5 | Ink 8 | Ink 7 | Ink 6 | Treatment Liquid 17 | Bar coating | 0.05 |
| Comparative Example 15 | Ink 9 | Ink 12 | Ink 11 | Ink 10 | Treatment Liquid 17 | Bar coating | 0.05 |
| Comparative Example 16 | Ink 1 | Ink 4 | Ink 3 | Ink 2 | Treatment Liquid 18 | Roll coating | 45 |
| Comparative Example 17 | Ink 5 | Ink 8 | Ink 7 | Ink 6 | Treatment Liquid 18 | Roll coating | 45 |
| Comparative Example 18 | Ink 9 | Ink 12 | Ink 11 | Ink 10 | Treatment Liquid 18 | Roll coating | 45 |

<Imaging Forming>

On a recording medium, each of the treatment liquids was applied by a wire bar coating method and dried with warm air, or applied by a roll coating method and allowed to dry under ambient conditions. High quality paper (MY PAPER: a basis weight of 69.6 g/m2, a sizing degree of 23.2 sec., an air permeability of 21 sec, manufactured by Ricoh Company, Ltd.) was used as recording medium.

After the drying in an atmosphere having a temperature of 23±0.5° C. and a relative humidity of 50±5%, a drive voltage of a piezo element was varied so as to uniformly discharge ink using an inkjet printer (IPSIO GX5000, manufactured by Ricoh Company, Ltd.) and form an image. Ink was the deposited on the treated recording media in the amounts shown in TABLE 1 and TABLE 2

Image density, image high saturation image, and color unevenness of the formed images were evaluated as described below.

<Image Density>

A 64 point symbol "■" was printed using Microsoft Word 2000 (by Microsoft Corporation). The print mode was set to "regular paper & standard fast" using a driver attached to the printer, and the color mating mode was not activated. The color of the symbol "■" on the print surface was measured using X-Rite 938 and evaluated on the following evaluation criteria.

[Evaluation Criteria]

A: black≥1.3, yellow≥0.85, magenta≥1.05, cyan≥1.1

B: 1.3>black≥1.2, 0.85>yellow≥0.8, 1.05>magenta≥1.0, 1.1≥cyan≥1.0

C: 1.2>black≥1.15, 0.8>yellow≥0.75, 1.0>magenta≥0.95, 1.0>cyan≥0.95

D: 1.15>black, 0.75>yellow, 0.95>magenta, 0.95>cyan

<Color Saturation>

A 64 point symbol "■" was printed using Microsoft Word 2000 (by Microsoft Corporation). The print mode was set to "regular paper & standard fast" using a driver attached to the printer, and the color mating mode was not activated. The color of the symbol "■" on the print surface was measured using X-Rite 938. The ratio of measured color saturation to that of the standard color (Japan color ver.2, yellow: 91.34, magenta: 74.55, cyan: 62.82) was calculated to evaluate the color saturation on the following evaluation criteria.

[Evaluation Criteria]

A: 0.85 or more

B: 0.8 or more to less than 0.85

C. 0.75 or more to less than 0.8

D: less than 0.75

<Color Unevenness>

A 64 point symbol "■" was printed using Microsoft Word 2000 (by Microsoft Corporation). The print mode was set to "regular paper & standard fast" using a driver attached to the printer, and the color mating mode was not activated. The existence of color unevenness on the print surface was visually observed, then judged using the following criteria.

[Evaluation Criteria]

A: No color unevenness was observed.

B: Slight amount of color unevenness was occurred, and hardly stand out.

C: Color unevenness was recognized.

D: Color unevenness was recognized clealy.

The results of the foregoing evaluations are shown in TABLE 3 and TABLE 4.

TABLE 3

| | Image evaluation | | |
|---|---|---|---|
| | Image density | Color Saturation | Color unevenness |
| Example 1 | A | B | A |
| Example 2 | B | B | B |
| Example 3 | B | B | B |
| Example 4 | A | A | B |
| Example 5 | A | A | B |
| Example 6 | B | B | B |
| Example 7 | A | A | A |
| Example 8 | A | A | A |
| Example 9 | A | A | B |
| Example 10 | A | A | A |
| Example 11 | A | A | A |
| Example 12 | A | A | B |
| Example 13 | A | A | A |
| Example 14 | A | A | A |
| Example 15 | A | A | B |
| Example 16 | A | B | B |
| Example 17 | B | B | B |
| Example 18 | B | B | B |
| Example 19 | B | B | B |
| Example 20 | B | B | B |
| Example 21 | B | B | B |
| Example 22 | B | B | B |
| Example 23 | B | B | B |
| Example 24 | B | B | B |
| Example 25 | B | B | B |
| Example 26 | B | B | B |
| Example 27 | B | B | B |
| Example 28 | B | B | B |
| Example 29 | B | B | B |
| Example 30 | B | B | B |
| Example 31 | B | B | B |
| Example 32 | B | B | B |
| Example 33 | B | B | B |
| Example 34 | B | B | B |
| Example 35 | B | B | B |
| Example 36 | B | B | B |
| Example 37 | B | B | B |
| Example 38 | B | B | B |
| Example 39 | B | B | B |

TABLE 4

| | Image evaluation | | |
|---|---|---|---|
| | Image density Black | Color Saturation Cyan | Color unevenness Magenta |
| Comparative Example 1 | D | C | C |
| Comparative Example 2 | D | C | C |
| Comparative Example 3 | D | D | D |
| Comparative Example 4 | C | C | C |
| Comparative Example 5 | C | C | C |
| Comparative Example 6 | D | D | D |
| Comparative Example 7 | C | D | D |
| Comparative Example 8 | C | D | D |
| Comparative Example 9 | D | D | D |
| Comparative Example 10 | D | D | D |
| Comparative Example 11 | D | D | D |
| Comparative Example 12 | D | D | D |
| Comparative Example 13 | D | D | D |
| Comparative Example 14 | D | D | D |
| Comparative Example 15 | D | D | D |
| Comparative Example 16 | D | D | D |
| Comparative Example 17 | D | D | D |
| Comparative Example 18 | D | D | D |

Where a numerical limit or range is stated herein, the endpoints are included. Also, all values and subranges within a numerical limit or range are specifically included as if explicitly written out.

Obviously, numerous modifications and variations of the present invention are possible in light of the above teachings. It is therefore to be understood that, within the scope of the appended claims, the invention may be practiced otherwise than as specifically described herein.

All patents and other references mentioned above are incorporated in full herein by this reference, the same as if set forth at length.

The invention claimed is:

1. An inkjet recording treatment liquid, comprising:

at least one water-soluble organic solvent;

water;

at least one compound according to formula (I)

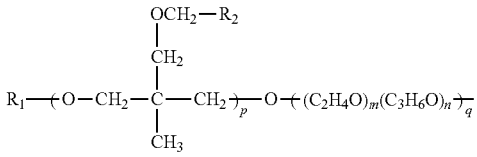

-continued

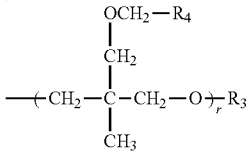

wherein:

each of $R_1$ and $R_3$ independently represents H, a lower alkoxy group, or a lower perfluoroalkoxy group;

each of $R_2$ and $R_4$ independently represents a lower perfluoroalkyl group, each of p, q, and r is independently an integer of 1 to 24;

m is an integer of 1 to 28; and n is an integer of 0 to 10; and at least one compound according to formula (II)

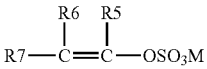

wherein:

each of R5, R6, and R7 independently represents a lower alkyl group, a lower perfluoroalkoxy group, or F; and M is Li, Na, or K.

2. The inkjet recording treatment liquid of claim 1, wherein the at least one water-soluble organic solvent comprises at least one member selected from the group consisting of 1,2,3-butanetriol, 1,2,4-butanetriol, glycerin, diglycerin, triethylene glycol, tetraethylene glycol, diethylene glycol, and 1,3-butandiol.

3. The inkjet recording treatment liquid of claim 1, wherein the at least one water-soluble organic solvent comprises a first water-soluble organic solvent and a second water-soluble organic solvent.

4. The inkjet recording treatment liquid of claim 3, wherein:

the first water-soluble organic solvent is present in an amount of at least 50% by mass relative to a total mass of the water-soluble organic solvent;

the first water-soluble organic solvent comprises at least one member selected from the group consisting of 1,2,3-butanetriol, 1,2,4-butanetriol, glycerin, diglycerin, triethylene glycol, tetraethylene glycol, diethylene glycol, and 1,3-butandiol; and the second water-soluble organic solvent comprises at least one member selected from the group consisting of polyhydric alcohols, polyhydric alcohol alkylethers, polyhydric alcohol arylethers, nitrogen-containing heterocyclic compounds, amides, amines, sulfur-containing compounds, propylene carbonate, and ethylene carbonate.

5. The inkjet recording treatment liquid of claim 1, wherein the at least one water-soluble organic solvent is present in an amount of from 15 to 60% by mass relative to a total mass of the inkjet recording treatment liquid.

6. The inkjet recording treatment liquid of claim 1, wherein, in the compound of formula (I):

each of p, q, and r is 1 to 4; and m is 10 to 21.

7. The inkjet recording treatment liquid of claim 6, wherein, in the compound of formula (I):

each of $R_1$ and $R_3$ is independently selected from the group consisting of $—OCH_3$, $—OC_2H_5$, $—OCF_3$, $—OC_2F_5$, $—OC_3F_7$, and $—OC_4F_9$; and each of $R_2$ and $R_4$ is independently selected from the group consisting of —$CF_3$, —$C_2F_5$, —$C_3F_7$, and —$C_4F_9$.

8. The inkjet recording treatment liquid of claim 1, wherein the compound of formula (I) is present in an amount of 0.1% by mass to 5% by mass relative to a total mass of the inkjet recording treatment liquid.

9. The inkjet recording treatment liquid of claim 1, wherein, in the compound of formula (II), each of $R_5$ to $R_7$ is independently selected from the group consisting of —$CH_3$, —$C_2H_5$, —$C_3H_7$, —$C_4F_9$, —$OCF_3$, —$OC_2F_5$, —$OC_3F_7$, —$OC_4F_9$, and —F.

10. The inkjet recording treatment liquid of claim 1, wherein the compound of formula (II) is present in an amount of 5% by mass to 30% by mass relative to a total mass of the inkjet recording treatment liquid.

11. The inkjet recording treatment liquid of claim 1, further comprising a penetrant in an amount of from 0.1% by mass to 5.0% by mass relative to a total mass of the inkjet recording treatment liquid.

12. The inkjet recording treatment liquid of claim 11, wherein the penetrant is selected from the group consisting of 2-ethyl-1,3-hexanediol, 2,2,4-trimethyl-1,3-pentanediol, 2-ethyl-2-methyl-1,3-propanediol, 3,3-dimethyl-1,2-butanediol, 2,2-diethyl-1,3-propanediol, 2-methyl-2-propyl-1,3-propanediol, 2,4-dimethyl-2,4-pentanediol, 2,5-dimethyl-2,5-hexanediol, 5-hexene-1,2-diol, diethylene thing phenyl ether, ethylene glycol phenyl ether, ethylene glycol allyl ether, diethylene glycol phenyl ether, diethylene glycol butyl ether, propylene glycol butyl ether, tetraethylene glycol chlorophenyl ether, and ethanol.

13. A method of inkjet recording, comprising:

applying the inkjet recording treatment liquid of claim 1 to a recording medium;

discharging ink from an inkjet printhead onto the recording medium.

14. The method of claim 13, wherein applying the inkjet recording treatment liquid to a recording medium comprises coating the inkjet recording treatment liquid onto the recording medium.

15. The method of claim 14, wherein the inkjet recording treatment liquid is coated using an applicator roller and a counter roller.

16. An inkjet recording apparatus, comprising:

a receptacle storing the inkjet recording treatment liquid of claim 1;

a receptacle storing an ink;

means for applying the inkjet recording treatment liquid to a recording medium; and means for discharging the ink onto the recording medium.

17. The inkjet recording apparatus of claim 16, wherein the means for applying the inkjet recording treatment liquid to the recording medium comprises an applicator roller and a counter roller.

18. The inkjet recording apparatus of claim 16, wherein the means for discharging the ink onto the recording medium comprises an inkjet printhead.

19. A storage bag, comprising:

a bag formed from a flexible film; and the inkjet recording treatment liquid of claim 1 retained within the bag.

20. A cartridge, comprising:

a rigid cartridge body; and the inkjet recording treatment liquid of claim 1 retained within the cartridge body.

* * * * *